US010688489B2

(12) United States Patent
Johnson et al.

(10) Patent No.: US 10,688,489 B2
(45) Date of Patent: Jun. 23, 2020

(54) FLUID RETENTION PLATES AND ANALYSIS CARTRIDGES

(71) Applicant: LUMINEX CORPORATION, Austin, TX (US)

(72) Inventors: Ross Johnson, Austin, TX (US); Chuck Collins, Austin, TX (US)

(73) Assignee: LUMINEX CORPORATION, Austin, TX (US)

( * ) Notice: Subject to any disclaimer, the term of this patent is extended or adjusted under 35 U.S.C. 154(b) by 136 days.

(21) Appl. No.: 15/427,432

(22) Filed: Feb. 8, 2017

(65) Prior Publication Data

US 2017/0144154 A1 May 25, 2017

Related U.S. Application Data

(63) Continuation of application No. 14/169,284, filed on Jan. 31, 2014, now Pat. No. 9,597,685.

(60) Provisional application No. 61/759,210, filed on Jan. 31, 2013.

(51) Int. Cl.
*B01L 3/00* (2006.01)

(52) U.S. Cl.
CPC ... *B01L 3/502715* (2013.01); *B01L 3/502792* (2013.01); *B01L 2200/10* (2013.01); *B01L 2200/16* (2013.01); *B01L 2300/044* (2013.01); *B01L 2300/0672* (2013.01); *B01L 2300/087* (2013.01); *B01L 2300/0816* (2013.01); *B01L 2300/0867* (2013.01); *B01L 2400/0427* (2013.01); *B01L 2400/0478* (2013.01); *B01L 2400/0481* (2013.01); *B01L 2400/0683* (2013.01); *Y10T 436/2575* (2015.01)

(58) Field of Classification Search
CPC ..... B01L 3/502715
USPC ..... 436/180
See application file for complete search history.

(56) References Cited

U.S. PATENT DOCUMENTS

| | | | | |
|---|---|---|---|---|
| 4,978,502 | A | 12/1990 | Dole et al. | 422/413 |
| 5,955,028 | A | 9/1999 | Chow | |
| 6,565,727 | B1 | 5/2003 | Shenderov | |
| 7,132,078 | B2 | 11/2006 | Rawson et al. | 422/403 |
| 7,419,638 | B2 | 9/2008 | Saltsman et al. | 422/504 |
| 7,569,129 | B2 | 8/2009 | Pamula et al. | |

(Continued)

FOREIGN PATENT DOCUMENTS

| | | |
|---|---|---|
| WO | WO 90/02938 | 3/1990 |
| WO | WO 2006/080186 | 8/2006 |

(Continued)

OTHER PUBLICATIONS

Invitation to Pay Additional Fees and partial Search Report, issued in European Application Serial No. 14746480.4, dated Sep. 28, 2016.

(Continued)

*Primary Examiner* — Lyle Alexander
*Assistant Examiner* — Emily R. Berkeley
(74) *Attorney, Agent, or Firm* — Parker Highlander PLLC

(57) ABSTRACT

Fluid storage containers and analysis cartridges for use in assay processes are presented. In addition, systems comprising such storage containers and analysis cartridges and methods of using such containers and cartridges are presented as well. In specific embodiments, fluid storage containers are configured to be coupled to analysis cartridges in a first stage and a second stage.

15 Claims, 18 Drawing Sheets

(56) References Cited

U.S. PATENT DOCUMENTS

| | | | | |
|---|---|---|---|---|
| 7,781,226 | B2 | 8/2010 | McDevitt et al. | 436/518 |
| 7,815,871 | B2 | 10/2010 | Pamula et al. | |
| 7,901,947 | B2 | 3/2011 | Pollack et al. | |
| 7,939,021 | B2 | 5/2011 | Smith et al. | |
| 7,998,436 | B2 | 8/2011 | Pollack et al. | |
| 8,041,463 | B2 | 10/2011 | Pollack | |
| 8,088,578 | B2 | 1/2012 | Hua | |
| 8,097,225 | B2 | 1/2012 | Padmanabhan et al. | 422/554 |
| 8,105,849 | B2 | 1/2012 | McDevitt et al. | 436/518 |
| 8,137,917 | B2 | 3/2012 | Pollack | |
| 8,208,146 | B2 | 6/2012 | Srinivasan et al. | |
| 8,268,246 | B2 | 9/2012 | Srinivasan et al. | |
| 8,304,253 | B2 | 11/2012 | Yi et al. | |
| 8,317,990 | B2 | 11/2012 | Pamula et al. | |
| 8,364,315 | B2 | 1/2013 | Sturmer et al. | |
| 8,454,905 | B2 | 6/2013 | Pope et al. | |
| 8,460,528 | B2 | 6/2013 | Pollack et al. | |
| 8,470,606 | B2 | 6/2013 | Srinivasan et al. | |
| 8,541,176 | B2 | 9/2013 | Pamula et al. | |
| 9,957,553 | B2 | 5/2018 | Kayyem et al. | |
| 2005/0103702 | A1* | 5/2005 | Zia | B01D 35/30 210/435 |
| 2005/0124013 | A1 | 6/2005 | Bonen et al. | 435/7.32 |
| 2006/0159586 | A1 | 7/2006 | Sasaki et al. | 436/45 |
| 2006/0166233 | A1 | 7/2006 | Wu et al. | 435/6.16 |
| 2006/0183216 | A1 | 8/2006 | Handique et al. | 435/287.1 |
| 2007/0172388 | A1 | 7/2007 | Padmanabhan et al. | 422/400 |
| 2007/0263049 | A1 | 11/2007 | Preckel et al. | 347/85 |
| 2007/0292941 | A1 | 12/2007 | Handique et al. | 435/288.7 |
| 2008/0199851 | A1 | 8/2008 | Egan et al. | 435/5 |
| 2009/0022624 | A1 | 1/2009 | Saltsman et al. | 422/400 |
| 2009/0304944 | A1 | 12/2009 | Sudarshan et al. | |
| 2010/0025250 | A1 | 2/2010 | Pamula et al. | |
| 2010/0032293 | A1 | 2/2010 | Pollack et al. | |
| 2010/0068764 | A1 | 3/2010 | Sista et al. | |
| 2010/0112723 | A1 | 5/2010 | Battrell et al. | 436/501 |
| 2010/0120130 | A1 | 5/2010 | Srinivasan et al. | |
| 2010/0173395 | A1 | 7/2010 | Saltsman et al. | 435/287.2 |
| 2010/0186524 | A1* | 7/2010 | Ariessohn | G01N 1/2202 73/863.22 |
| 2010/0221713 | A1 | 9/2010 | Pollack et al. | |
| 2010/0282608 | A1 | 11/2010 | Srinivasan et al. | |
| 2010/0285490 | A1* | 11/2010 | Dees | G01N 33/54373 435/7.1 |
| 2011/0059547 | A1 | 3/2011 | Dehal et al. | 436/174 |
| 2011/0097763 | A1 | 4/2011 | Pollack et al. | |
| 2011/0104816 | A1 | 5/2011 | Pollack et al. | |
| 2011/0186466 | A1 | 8/2011 | Kurowski et al. | 206/524.6 |
| 2012/0018306 | A1 | 1/2012 | Srinivasan et al. | |
| 2012/0064612 | A1 | 3/2012 | Saltsman et al. | 435/287.1 |
| 2012/0107811 | A1 | 5/2012 | Kelso et al. | 435/6.11 |
| 2012/0132528 | A1 | 5/2012 | Shenderov | |
| 2012/0164627 | A1 | 6/2012 | Battrell et al. | 435/5 |
| 2012/0177543 | A1 | 7/2012 | Battrell et al. | 422/187 |
| 2012/0190128 | A1 | 7/2012 | Nikbakht et al. | 436/180 |
| 2012/0261264 | A1 | 10/2012 | Srinivasan et al. | |
| 2013/0059366 | A1 | 3/2013 | Pollack et al. | |
| 2013/0168250 | A1 | 7/2013 | Fogleman et al. | |
| 2013/0206597 | A1 | 8/2013 | Wang et al. | |
| 2013/0217103 | A1 | 8/2013 | Bauer | |
| 2013/0217113 | A1 | 8/2013 | Srinivasan et al. | |

FOREIGN PATENT DOCUMENTS

| | | |
|---|---|---|
| WO | WO 2008/118571 | 9/2008 |
| WO | WO 2009/140373 | 11/2009 |
| WO | WO 2010/036808 | 4/2010 |
| WO | WO 2012/151192 | 11/2012 |
| WO | WO 2013/006312 | 1/2013 |
| WO | WO 2013/016413 | 1/2013 |
| WO | WO 2013/022745 | 2/2013 |
| WO | WO 2013/040562 | 3/2013 |
| WO | WO 2013/090889 | 6/2013 |

OTHER PUBLICATIONS

International Search Report and Written Opinion, issued in PCT/US2014/014000, dated May 12, 2014.

Office Action, issued in Chinese Patent Application Serial No. 201480006568.2, dated Apr. 18, 2016.

Office Action, issued in U.S. Appl. No. 14/169,284, dated Mar. 16, 2016.

Office Action, issued in U.S. Appl. No. 14/169,284, dated Jul. 25, 2016.

Extended Search Report and Opinion, issued in European Patent Application No. 14 746 480.4, dated Jan. 10, 2017.

Extended European Search Report issued in corresponding Europe Pat. Appl. No. 18193146.0, dated Feb. 4, 2019.

* cited by examiner

FLUID RETENTION PLATES AND ANALYSIS CARTRIDGES

CROSS-REFERENCE TO RELATED APPLICATIONS

This application is continuation of U.S. patent application Ser. No. 14/169,284, filed Jan. 31, 2014, which claims priority to U.S. Provisional Patent Application Ser. No. 61/759,210, filed Jan. 31, 2013, the contents of which are incorporated by reference herein.

FIELD OF THE INVENTION

This invention relates to bulk fluid storage containers configured for use with printed circuit boards (PCB) or "labs on a chip" to perform fluid assays. In particular, this invention relates to bulk fluid storage containers that are configured to be disposable (in other words, are configured for a single use) and are further configured to be partially or fully preloaded with reagents, oils, or other fluids for performing a fluid assay.

BACKGROUND

The following descriptions and examples are not admitted to be prior art by virtue of their inclusion within this section.

Fluid assays are used for a variety of purposes, including but not limited to biological screenings and environmental assessments. Sometimes, fluid assays may need to be performed in the field away from a laboratory. In the field environment it is useful to have a system that is capable of performing the entire assay from sample preparation to analysis (sample to answer) without the use of conventional laboratory tools. This type of system may, for example, take in a user input sample and process the sample using reagents, heat, magnetic particles, and/or imaging to produce an assay result for the sample.

SUMMARY OF THE INVENTION

Fluid storage containers and analysis cartridges for use in assay processes are presented. In addition, systems comprising such storage containers and analysis cartridges and methods of using such containers and cartridges are presented. In specific embodiments, fluid storage containers are configured to be coupled to analysis cartridges in a first stage and a second stage.

Exemplary embodiments include a system comprising a first plate and a second plate coupleable to the first plate. In certain embodiments, the first plate may comprise: a first side; a second side; a first reservoir coupled to the first side of the first plate; a protrusion extending from the second side of the first plate; a first channel extending from the first side of the first plate through the protrusion on the second side of the first plate; a fluid displacement mechanism in fluid communication with the first reservoir and the first channel; and a pierceable seal coupled to the protrusion extending from the second side of the first plate and covering the first channel. In specific embodiments, the second plate may comprise: a first side; a second side; a protrusion extending from the first side of the second plate and configured to mate with the protrusion on the second side of the first plate; a piercing element associated with the protrusion extending from the first side of the second plate, where the piercing element is configured to extend through the pierceable seal when the protrusion on the second side of the first plate is mated with the protrusion extending from the first side of the second plate; and a second channel in fluid communication with the protrusion extending from the first side of the second plate.

In particular embodiments, the fluid displacement mechanism may be a piston. In certain embodiments, the fluid displacement mechanism may be a flexible blister. In specific embodiments, the first plate may further comprise a sample fluid displacement mechanism and a sample input channel configured to conduct a fluid from the first side of the first plate to the sample fluid displacement mechanism. Particular embodiments may also comprise a removable sample input cap coupled to a sample reservoir. Certain embodiments may further comprise a gasket coupled to the second side of the first plate, where the gasket is configured to form a substantially fluid-tight seal between the protrusion extending from the first side of the second plate and the protrusion extending from the second side of the first plate.

Specific embodiments may further comprise an assay surface coupled to the second side of the second plate. In particular embodiments, the assay surface may comprise an electrowetting surface. In certain embodiments, the assay surface may comprise microfabricated channels and/or one or more heating elements.

In specific embodiments, the second plate may comprise a vent extending from the first side of the second plate to the second side of the second plate. Certain embodiments may further comprise a hydrophobic nylon mesh coupled to at least a portion of the first side of the second plate and covering the vent. In particular embodiments, the second side of the first plate may be coupled to the first side of the second plate.

In specific embodiments, the first plate may comprise: a plurality of protrusions extending from the second side of the first plate; a plurality of reservoirs; a plurality of channels extending from the first side of the first plate through the plurality of protrusions on the second side of the first plate; a plurality of fluid displacement mechanisms, where each fluid displacement mechanism is in fluid communication with a reservoir and a channel extending from the first side of the first plate through the plurality of protrusions on the second side of the first plate. In certain embodiments, the first plate may also comprise a plurality of pierceable seals, where each pierceable seal in the plurality of pierceable seals is coupled to one of the protrusions in the plurality of protrusions extending from the second side of the first plate, and where each pierceable seal covers at least a portion of one of the channels in the plurality of channels.

In particular embodiments, the second plate may comprise: a plurality of protrusions extending from the first side of the second plate, each protrusion of which is respectively configured to mate with one of the protrusions in the plurality of protrusions on the second side of the first plate. In specific embodiments, the second plate may comprise a plurality of piercing elements, where each piercing element is configured to pierce one of the pierceable seals in the plurality of pierceable seals when the protrusions on the second side of the first plate are respectively mated with the protrusions extending from the first side of the second plate. In certain embodiments, the second plate may comprise a plurality of channels extending from the second side of the second plate through the plurality of piercing elements disposed within the protrusions extending from the first side of the second plate.

In particular embodiments, the first plate may have a thickness between 0.05 inches and 0.5 inches. In specific embodiments, the second plate may have a thickness between 0.05 inches and 0.5 inches. In certain embodiments, the first plate may be a rigid plastic plate. In particular embodiments the second plate may be a rigid plastic plate.

Embodiments of fluid storage containers are disclosed. In certain embodiments, a fluid storage container may be configured to be coupled to an analysis cartridge. The fluid storage container may comprise: a bulk fluids plate comprising: at least one reagent reservoir unit comprising: a barrel comprising a channel; a pierceable seal coupled to the barrel; and a fluid displacement mechanism in fluid communication with the channel; where each reagent reservoir unit is configured to contain a volume of fluid. In various embodiments, each barrel may be considered a protrusion extending from a side (e.g., the bottom side) of the bulk fluids plate.

In certain embodiments, the bulk fluids plate has a bottom side, and the bulk fluids plate may further comprise a first pair of tabs and a second pair of tabs, where the first pair of tabs is longer than the second pair of tabs, and each tab extends from the bottom side. In particular embodiments, the bulk fluids plate also includes a sample reservoir unit.

Particular embodiments may comprise a sample dispensing channel in fluid communication with the sample reservoir. In specific embodiments, the sample reservoir may comprise: a removable sample input cap; a sample input channel; and a sample fluid displacement mechanism in fluid communication with the sample input channel. In particular embodiments, the bulk fluids plate has a top side, and the removable sample input cap may be located on the top side, and the sample fluid displacement mechanism may be located on the bottom side. In certain embodiments, the bulk fluids plate may further comprise a sample control reservoir configured to retain a sample control. In particular embodiments, the bulk fluids plate may further comprise a lysis fluid displacement mechanism in fluid communication with a volume of lysate, a lysis fluid displacement mechanism in fluid communication with a volume of lysate. In particular embodiments, the lysate is configured to be delivered to the sample control reservoir when the lysis fluid displacement mechanism is actuated.

In certain embodiments, the sample reservoir unit may be in fluid communication with the sample control reservoir via a lysis channel. In particular embodiments, the bulk fluids plate may comprise a gasket coupled to at least one protrusion. In specific embodiments, the bulk fluids plate may comprise a plurality of protrusions, and the gasket may comprise a plurality of holes equal or greater in number to the number of protrusions in the plurality of protrusions. In certain embodiments, each reagent reservoir unit may contain a volume of fluid selected from the group consisting of oil, imaging dilution buffer, binding beads, binding buffer, wash buffer, rehydration buffer, and lysis buffer.

In particular embodiments, each reagent reservoir unit may comprise between about 20 uL and about 20 mL of fluid. In specific embodiments, each reagent reservoir unit may comprise between about 20 uL and about 20 mL of fluid. In certain embodiments, the bulk fluids plate may comprise eight reagent reservoir units. In particular embodiments, a protrusion may comprise a distal end distal from the fluid displacement mechanism and the pierceable seal may be located on the distal end of the protrusion. In specific embodiments, the pierceable seal may comprise foil. In certain embodiments, the bulk fluids plate may comprise plastic.

Certain embodiments include a fluid storage container comprising: a syringe barrel array comprising: multiple isolated reservoirs in a single part or multiple individual reservoirs in separate parts comprising: a barrel comprising a channel; a pierceable seal coupled to the barrel; and a piston or some other means to achieve a fluid tight seal that when actuated results in a positive displacement pump action, covering a portion of the channel; where each reagent reservoir unit is configured to contain a volume of fluid.

In specific embodiments, a fluid storage container configured to be coupled to an analysis cartridge is disclosed, the fluid storage container comprising: a bulk fluids plate comprising: at least one reagent reservoir unit comprising: a barrel comprising a channel; a pierceable seal coupled to the barrel; and a fluid displacement mechanism (including e.g. a piston or flexible blister) covering at least a portion of the channel; where each reagent reservoir unit is configured to contain a volume of fluid. In various embodiments, each barrel may be considered a protrusion extending from a side (e.g., the bottom side) of the bulk fluids plate.

Another embodiment may be a fluid storage container comprising: a syringe barrel array comprising: multiple isolated reservoirs in a single part or multiple individual reservoirs in separate parts comprising: a barrel comprising a channel; a pierceable seal coupled to the barrel; and a piston or some other means to achieve a fluid tight seal that when actuated results in a positive displacement pump action, covering a portion of the channel; where each reagent reservoir unit is configured to contain a volume of fluid.

In other embodiments, an analysis cartridge may be configured to be coupled to a fluid storage container. In certain embodiments, the analysis cartridge may comprise: a retention plate comprising: a top side and a bottom side; a plurality of bosses, each boss comprising: a chamber having a floor; and a lance extending from the floor and comprising a conduit through the floor; where each boss is configured to receive a barrel and each lance is configured to pierce a pierceable seal on the barrel; and a plurality of dispensing reservoirs, each dispensing reservoir in fluid communication with a conduit of one of the plurality of bosses. In various embodiments, each boss may be considered a protrusion extending from a side (e.g., the top side) of the retention plate.

In certain embodiments, the retention plate may comprise a plurality of slots extending between the top side and the bottom side. Particular embodiments may comprise a printed circuit board (PCB) coupled to the bottom side of the retention plate. In specific embodiments, each lance may be between about 0.005" tall and about 0.080" tall. In certain embodiments, bosses in the plurality of protrusions may be disposed on the top side of the retention plate.

In still other embodiments, a system is disclosed comprising: a first plate comprising: a first side; a second side; a protrusion extending from the second side of the first plate; a first channel extending from the first side of the first plate through the protrusion on the second side of the first plate; a fluid displacement mechanism (e.g. a piston or a flexible blister) coupled to the first side of the first plate and defining a volume over the first channel; and a pierceable seal coupled to the protrusion extending from the second side of the first plate and covering the first channel; and a second plate coupleable to the first plate comprising: a first side; a second side; a protrusion extending from the first side of the second plate and configured to receive the protrusion on the second side of the first plate; a piercing element disposed within the protrusion extending from the first side of the second plate, where the piercing element is configured to pierce the pierceable seal when the protrusion on the second side of the first plate is disposed in the protrusion extending from the first side of the second plate; and a second channel extending from the second side of the second plate through the piercing element disposed within the protrusion extending from the first side of the second plate.

In certain embodiments, a flexible blister may be coupled to the first plate with an adhesive. Particular embodiments may comprise a sample blister coupled to the second side of the first plate and a sample input channel configured to conduct a fluid from the first side of the first plate to the sample blister. Specific embodiments may comprise a removable sample input cap coupled to the first side of the first plate and covering the sample input channel. Certain embodiments may comprise a gasket coupled to the second side of the first plate, where the gasket is configured to form a substantially fluid-tight seal between the protrusion extending from the first side of the second plate and the second side of the first plate. Particular embodiments may comprise a gasket coupled to the second side of the first plate, where the gasket is configured to form a substantially fluid-tight seal between the protrusion extending from the first side of the second plate and the second side of the first plate. Specific embodiments may comprise a gasket coupled to the second side of the first plate, where the gasket is configured to form a substantially fluid-tight seal between the protrusion extending from the first side of the second plate and the second side of the first plate. In particular embodiments, the assay surface may comprise an electrowetting surface, microfabricated channels, and/or microfabricated channels.

In certain embodiments, the second plate may comprise a vent extending from the first side of the second plate to the second side of the second plate. Particular embodiments may comprise a hydrophobic nylon mesh coupled to at least a portion of the first side of the second plate and covering the vent. In specific embodiments the second side of the first plate may be coupled to the first side of the second plate. In certain embodiments the first plate may comprise: a plurality of protrusions extending from the second side of the first plate; a plurality of channels extending from the first side of the first plate through the plurality of protrusions on the second side of the first plate; a plurality of flexible blisters coupled to the first side of the first plate, where each blister of the plurality of blisters at least partially covers at least one channel of the plurality of channels; and a plurality of pierceable seals, where each pierceable seal in the plurality of pierceable seals is coupled to one of the protrusions in the plurality of protrusions extending from the second side of the first plate, and where each pierceable seal covers at least a portion of one of the channels in the plurality of channels.

In particular embodiments, the second plate may comprise: a plurality of protrusions extending from the first side of the second plate, each protrusion of which is respectively configured to mate with one of the protrusions in the plurality of protrusions on the second side of the first plate; a plurality of piercing elements, where each piercing element is configured to pierce one of the pierceable seals in the plurality of pierceable seals when the protrusions on the second side of the first plate are respectively mated with the protrusions extending from the first side of the second plate; and a plurality of channels extending from the second side of the second plate through the plurality of piercing elements disposed within the protrusions extending from the first side of the second plate.

In specific embodiments, the first plate may have a thickness between 0.05 inches and 0.5 inches. In some embodiments, the second plate may have a thickness between 0.05 inches and 0.5 inches. In certain embodiments, the first plate and/or the second plate may be a rigid plastic plate.

In other embodiments, a system is disclosed comprising: a fluid storage container comprising: a bulk fluids plate comprising: a top side and a bottom side; a sample reservoir configured to receive a sample volume; a plurality of reagent reservoirs, each of which comprises a fluid volume; and a first pair of tabs and a second pair of tabs, where each tab in the first pair of tabs is longer than each tab in the second pair of tabs, and the tabs extend from the bottom side; and an analysis cartridge coupleable to the fluid storage container, the analysis cartridge comprising: a retention plate comprising: a top side and a bottom side; a plurality of bosses, each boss comprising a chamber, a floor, and a conduit through the floor: a plurality of dispensing reservoirs, each dispensing reservoir in fluid communication with a conduit of one of the bosses; and a plurality of slots, each slot being sized and positioned to respectively receive one of the tabs in the first and second pairs of tabs when the analysis cartridge and the fluid storage container are coupled to each other in an engaged state, the system being configured such that in an intermediate stage of coupling, fewer than all of the tabs extend respectively through all of the slots.

In particular embodiments, the analysis cartridge may comprise an analysis element coupled to the retention plate. In some embodiments, the fluid storage container may be configured to be coupled to the analysis cartridge in a first stage and a second stage. In specific embodiments, the fluid storage container may be coupled to the analysis cartridge with the plurality of pierceable seals intact in the first stage; and the fluid storage container may be coupled to the analysis cartridge with at least one pierceable seal pierced by the analysis cartridge in the second stage. In certain embodiments, each flexible blister of each reagent reservoir unit may project from the top side of the bulk fluids plate. In particular embodiments, the fluid storage container may further comprise a first pair of tabs and a second pair of tabs, where the first pair of tabs is longer than the second pair of tabs and the tabs extend from the bottom side of the fluid storage container. In specific embodiments, the analysis cartridge may further comprise a plurality of slots, and at least four of the slots may be configured to receive a tab of the fluid storage container.

In particular embodiments, the fluid storage container may comprise a sample reservoir unit. In certain embodiments, the sample reservoir unit may comprise a removable sample input cap, a removable sample input cap, and a sample blister. In some embodiments, the fluid storage container may be coupled to the analysis cartridge in the first stage. In specific embodiments, each reagent reservoir unit may contain a volume of fluid selected from the group consisting of oil, imaging dilution buffer, binding beads, binding buffer, wash buffer, rehydration buffer, and lysis buffer. In certain embodiments, the fluid storage container may further comprise a frangible lysis blister configured to contain a volume of lysis buffer. In particular embodiments, the fluid storage container may comprise a sample control. In some embodiments, the analysis cartridge may comprise a printed circuit board coupled to the retention plate.

In still other embodiments a method of preparing an assay is disclosed comprising obtaining a system comprising a fluid storage container and an analysis cartridge coupleable to the fluid storage container. In some embodiments, the fluid storage container may comprise: a bulk fluids plate comprising: a top side and a bottom side; a sample reservoir configured to receive a sample volume; a plurality of reagent reservoirs, each of which comprises a fluid volume; and a first pair of tabs and a second pair of tabs, where each tab in the first pair of tabs is longer than each tab in the second pair of tabs, and the tabs extend from the bottom side. In some embodiments, the analysis cartridge may comprise: a retention plate comprising: a top side and a bottom side; a plurality of bosses, each boss comprising a chamber, a floor, and a conduit through the floor: a plurality of dispensing reservoirs, each dispensing reservoir in fluid communication with a conduit of one of the bosses; and a plurality of slots, each slot being sized and positioned to respectively receive one of the tabs in the first and second pairs of tabs when the analysis cartridge and the fluid storage container are coupled to each other in an engaged state, the system being configured such that in an intermediate stage of coupling, fewer than all of the tabs extend respectively through all of the slots. In particular embodiments, the method may also comprise adding a volume of sample to the sample reservoir; and coupling the fluid storage container to the analysis cartridge in the first stage.

In certain embodiments, the fluid storage container may be coupled to the analysis cartridge prior to adding the volume of sample to the sample reservoir unit. In particular embodiments, the fluid storage container may be coupled to the analysis cartridge in a first stage with the pierceable seals intact prior to adding the volume of sample to the sample reservoir unit. Certain embodiments may comprise coupling the fluid storage container to the analysis cartridge in a second stage with at least one of the pierceable seals pierced. In specific embodiments, the fluid storage container may be coupled to the analysis cartridge after adding the volume of sample to the sample reservoir unit.

Particular embodiments may comprise actuating the flexible blister of at least one of the plurality of reagent reservoir units to deliver the volume of fluid in the reagent reservoir unit to the analysis element via the conduit in the lance. Specific embodiments may comprise actuating two or more of the flexible blisters simultaneously. Certain embodiments may comprise actuating two or more of the flexible blisters sequentially. In particular embodiments, at least one of the plurality of reagent reservoir units comprises a volume of oil, and the flexible blister of the at least one reagent reservoir unit comprising a volume of oil may be actuated before actuating the flexible blister of any of the other reagent reservoir units and before actuating the sample blister.

In certain embodiments, the fluid storage container further comprises a frangible lysis blister comprising a lysis buffer, and the method may comprise actuating frangible lysis blister such that lysis buffer is distributed to the volume of sample.

In various embodiments of the disclosed apparatuses, systems, and methods, the fluid storage container may comprise one, two, three, four, five, six, seven, eight, nine, ten, eleven, twelve, thirteen, fourteen, fifteen, sixteen, seventeen, eighteen, nineteen, twenty, or more reagent reservoir units. Also in such disclosed embodiments, the analysis cartridge may comprise one, two, three, four, five, six, seven, eight, nine, ten, eleven, twelve, thirteen, fourteen, fifteen, sixteen, seventeen, eighteen, nineteen, twenty, or more bosses (or protrusions). In preferred embodiments, the number of bosses (or protrusions) is equal to the total number of reagent reservoir units and sample reservoir units.

In certain embodiments of the disclosed apparatuses, systems, and methods, the fluid storage container may come preloaded with fluids in one or more of the reagent reservoir units for performing a fluid assay. The reagent reservoirs may comprise oil, imaging dilution buffer, binding beads, binding buffer, wash buffer, rehydration buffer, and lysis buffer in various embodiments. In specific embodiments, each reagent reservoir unit may comprise between about 20 uL and about 20 mL, between about 20 uL and about 2 mL, between about 20 uL and about 1 mL, between about 20 uL and about 200 uL, between about 50 uL and about 2 mL, or between about 10 uL and about 200 uL of fluid.

In various embodiments of the disclosed apparatuses, systems, and methods, the fluid storage container comprises a first tab and a second tab, where the first tab and second tab are of different lengths. In preferred embodiments, the tabs are paired such that there are at least two tabs of a substantially the same length. In still other embodiments, the longer tabs may be considered fastening tabs and the shorter tabs may be considered engaging tabs. In such embodiments, there may be one, two, three, four, five, or more pairs of fastening tabs and one, two, three, four, five, or more pairs of engaging tabs.

In addition, in various embodiments of the disclosed apparatuses, systems, and methods, the analysis cartridge may comprise slots through the top and bottom of the retention plate configured to receive and equal or greater in number to the total number of tabs. So, in various embodiments, the analysis cartridge may comprise one, two, three, four, five, six, seven, eight, nine, ten, eleven, twelve, thirteen, fourteen, fifteen, sixteen, seventeen, eighteen, nineteen, twenty, or more slots.

In alternate embodiments of the disclosed apparatuses, systems and methods, the slots may be located on the fluid storage container and the tabs may be located on the analysis cartridge.

In alternate embodiments of the disclosed apparatuses additional fasteners such as threaded features can be used to engage the fluid storage container to the analysis cartridge.

In certain embodiments of the disclosed apparatuses, systems, and methods, each boss of the analysis cartridge comprises a lance, the height of which may be about 0.100", 0.120", 0.140", 0.160", 0.180", 0.200", 0.220", 0.240", or 0.260".

In some embodiments of the disclosed apparatuses, systems, and methods, the fluid storage container and/or the analysis cartridge further comprises a gasket configured to form a substantially leak-proof seal with at least a portion of the analysis cartridge when the fluid storage container is coupled to the analysis cartridge in the second stage. In certain specific embodiments, the gasket may comprise a plurality of holes equal or greater in number to the total number of the plurality of barrels or bosses, that is, the gasket may comprise one, two, three, four, five, six, seven, eight, nine, ten, eleven, twelve, thirteen, fourteen, fifteen, sixteen, seventeen, eighteen, nineteen, twenty, or more holes.

Embodiments of the disclosed fluid storage containers and analysis cartridges may comprise polycarbonate, polyurethane, polyester, epoxy resin, phenolic resin, polyethylene (PE), polypropylene (PP), polyvinyl chloride (PVC), or polyethylene terephthalate (PET or PETE).

The term "coupled" is defined as connected, although not necessarily directly, and not necessarily mechanically. Two items are "coupleable" if they can be coupled to each other, and, when coupled, may still be characterized as "coupleable." Unless the context explicitly requires otherwise, items that are coupleable are also decoupleable, and vice-versa. One non-limiting way in which a first structure is coupleable to a second structure is for the first structure to be configured to be coupled (or configured to be coupleable) to the second structure.

The terms "a" and "an" are defined as one or more unless this disclosure explicitly requires otherwise.

The term "substantially" and its variations (e.g., "approximately" and "about") are defined as being largely but not necessarily wholly what is specified (and include wholly what is specified) as understood by one of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. Likewise, a step of a method or an element of a device that "comprises," "has," "includes" or "contains" one or more features possesses those one or more features, but is not limited to possessing only those one or more features. For example, a fluid retention plate that comprises a sample reservoir unit has one sample reservoir unit, but may have more than one sample reservoir unit.

Furthermore, a device or structure that is configured in a certain way is configured in at least that way, but may also be configured in ways that are not listed. Metric units may be derived from the English units provided by applying a conversion and rounding to the nearest millimeter.

The feature or features of one embodiment may be applied to other embodiments, even though not described or illustrated, unless expressly prohibited by this disclosure or the nature of the embodiments.

Any embodiment of any of the disclosed devices and methods can consist of or consist essentially of—rather than comprise/include/contain/have—any of the described elements and/or features and/or steps. Thus, in any of the claims, the term "consisting of" or "consisting essentially of" can be substituted for any of the open-ended linking verbs recited above, in order to change the scope of a given claim from what it would otherwise be using the open-ended linking verb.

Other features and associated advantages will become apparent with reference to the following detailed description of specific embodiments in connection with the accompanying drawings.

BRIEF DESCRIPTION OF THE DRAWINGS

The following drawings illustrate by way of example and not limitation. For the sake of brevity and clarity, every feature of a given structure may not be labeled in every figure in which that structure appears. Identical reference numbers do not necessarily indicate an identical structure. Rather, the same reference number may be used to indicate a similar feature or a feature with similar functionality, as may non-identical reference numbers.

The embodiments of the present fluid storage containers and analysis cartridges shown in FIGS. 1-10B are drawn to scale.

DETAILED DESCRIPTION

Various features and advantageous details are explained more fully with reference to the non-limiting embodiments that are illustrated in the accompanying drawings and detailed in the following description. It should be understood, however, that the detailed description and the specific examples, while indicating embodiments of the invention, are given by way of illustration only, and not by way of limitation. Various substitutions, modifications, additions, and/or rearrangements will become apparent to those of ordinary skill in the art from this disclosure.

In the following description, numerous specific details are provided to provide a thorough understanding of the disclosed embodiments. One of ordinary skill in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
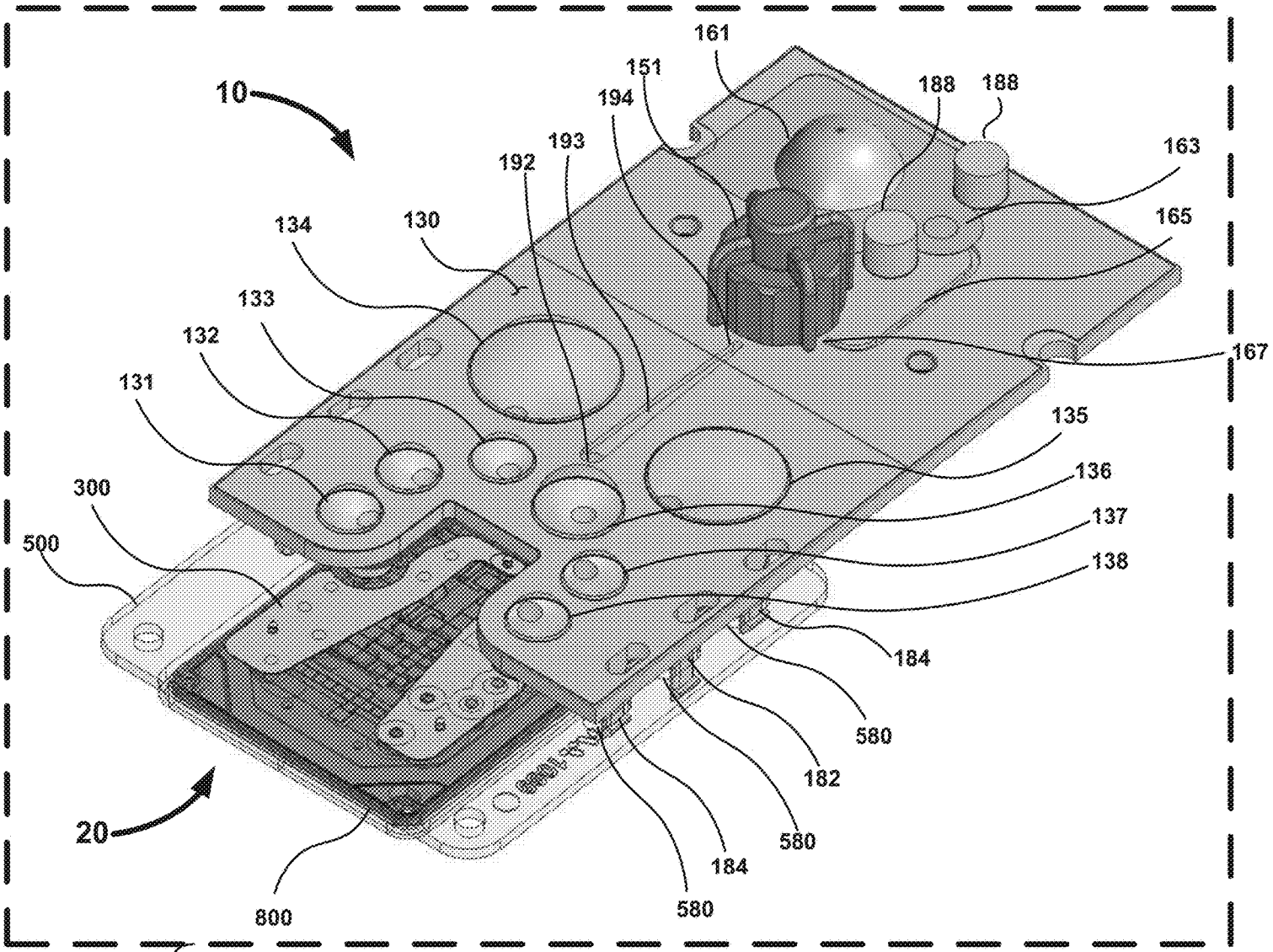
FIG. 1 is a top perspective view of embodiments of an assembly of a fluid storage container and an analysis cartridge.
Figure 2:
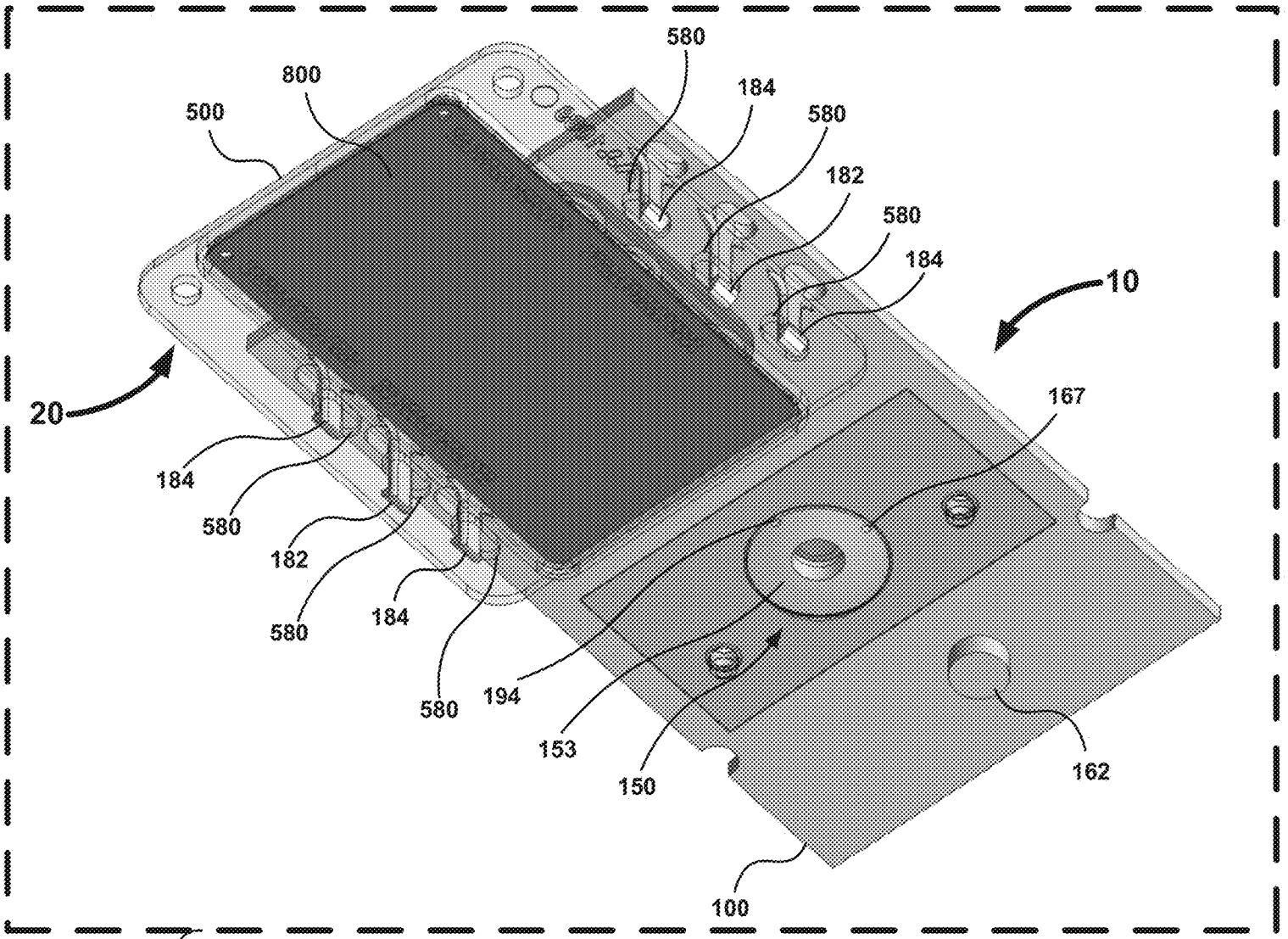
FIG. 2 is a bottom perspective view of embodiments of an assembly of a fluid storage container and an analysis cartridge.
Figure 3:
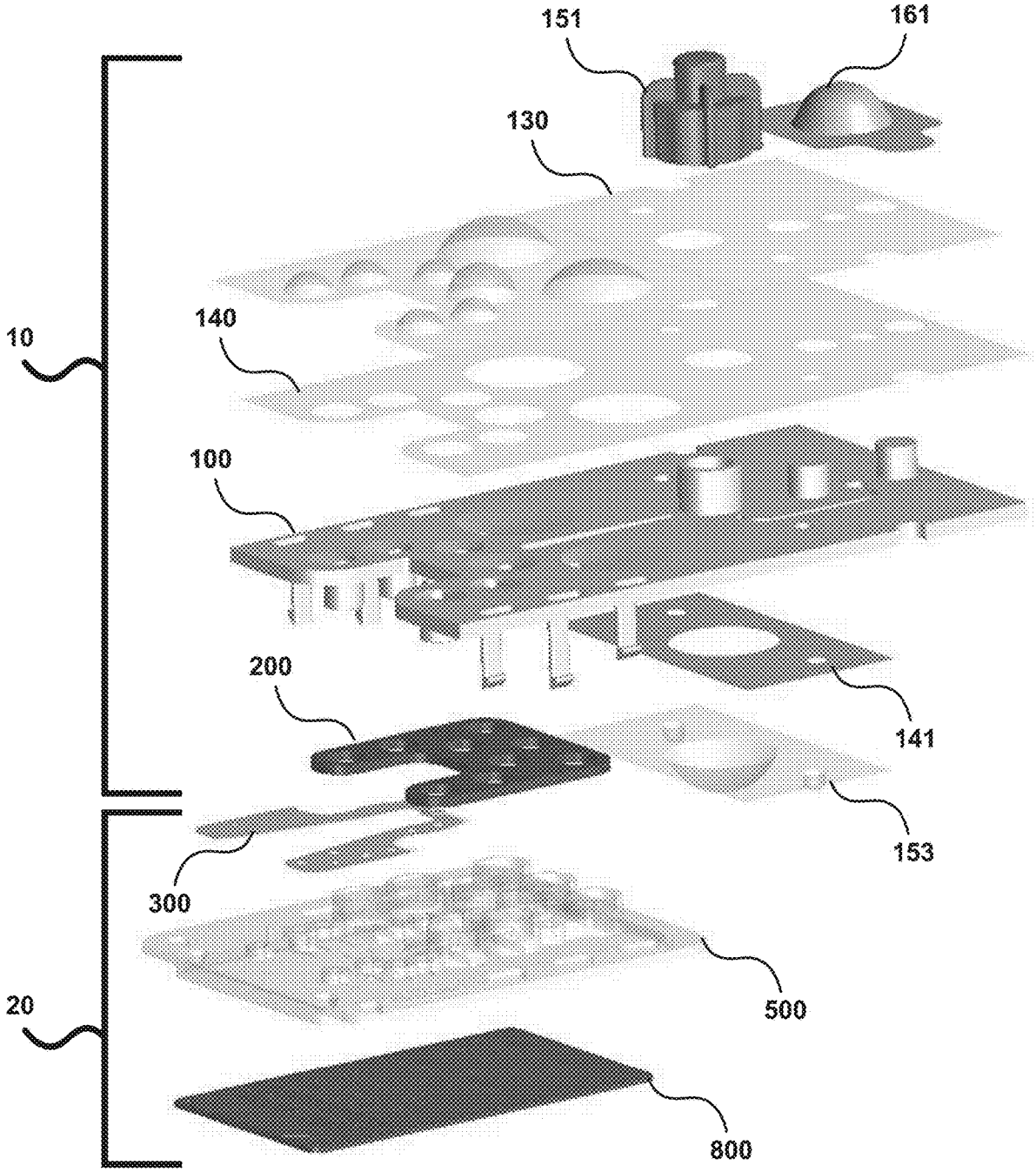
FIG. 3 is an exploded view of embodiments of a fluid storage container and an analysis cartridge.
Figure 4:
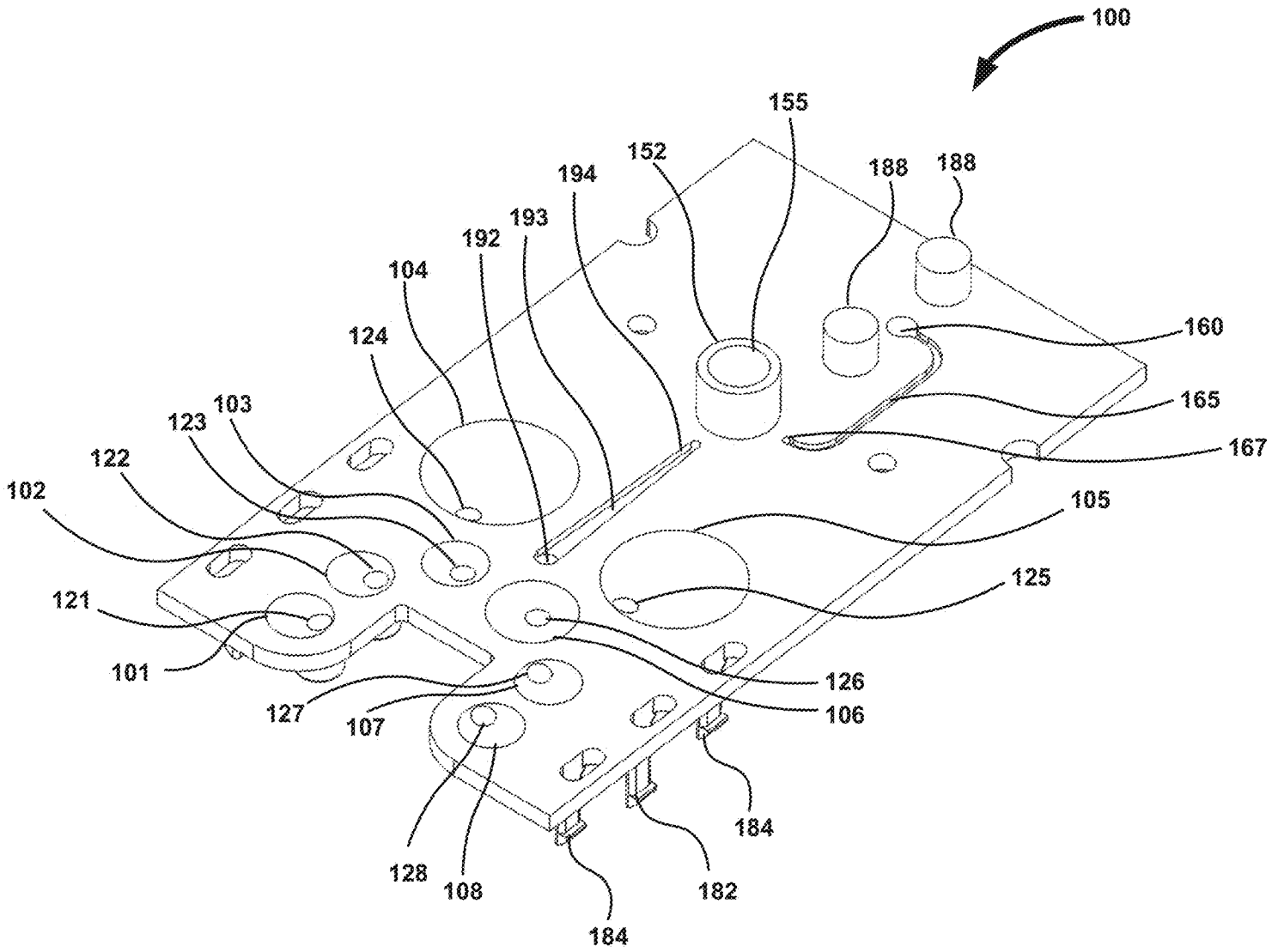
FIG. 4 is a top perspective view of an embodiment of a bulk fluids plate.

FIGS. 1 and 2 are top and bottom perspective views, respectively, of system 5—one embodiment of the present systems—which comprises fluid storage container 10 (one embodiment of the present containers) coupled to analysis cartridge 20 (one embodiment of the present cartridges). FIG. 3 is an exploded view of fluid storage container 10 and analysis cartridge 20.

While container 10 and cartridge 20 may be sold or provided in system 5, they may also be sold or provided separately, as may other embodiments of the present systems, containers, and cartridges.

As discussed in more detail below, fluid storage container 10 comprises a plurality of reservoir units that may be preloaded with liquid reagents, oils, or other fluids usable to perform an assay. Fluid storage container 10 may comprise reservoir units that contain assay components that are not in fluidic form, such as lyophilized, dried, or powdered reagents. In the embodiments shown, the fluid assay is performed by an analysis element, such as the printed circuit board (PCB) 800, which is coupled to analysis cartridge 20. In other embodiments, other suitable analysis elements may be used.

For example, certain embodiments of the present fluid storage containers are configured to be coupled to an analysis cartridge in at least two stages. Turning to system 5 specifically, in the first or "fastened" stage, fluid storage container 10 is secured to analysis cartridge 20 such that fluid storage container 10 is not readily separable from analysis cartridge 20. In the second or "engaged" stage, fluid storage container 10 is secured to analysis cartridge 20 such that lances on cartridge 20 pierce seals on the reservoirs containing the fluids. A fluid-tight (or substantially fluid-tight) path is thereby created between each reservoir and the PCB. Each reservoir unit may be sequentially engaged such that fluid is forced from the reservoir, along the fluid path, and onto the PCB to perform a fluid assay.

Fluid Storage Container

As shown in FIGS. 1-7, and especially in FIG. 3, fluid storage container 10 comprises a bulk fluids plate 100 coupled to a blister layer 130 via an adhesive layer 140. Bulk fluids plate 100 comprises a plurality of barrels 111-119 (see FIG. 5) protruding downward from the underside of bulk fluids plate 100. These barrels may also be characterized as protrusions. In the embodiment shown in FIG. 7, gasket 200 is configured to be coupled to bulk fluids plate 100 such that the plurality of holes 201-209 in gasket 200 mate with the plurality of barrels 111-119. In the illustrated embodiment, barrels 111-119 are substantially cylindrical in shape (in other words, they have a substantially circular cross section), but in other embodiments the barrels have other shapes (and shapes that differ from each other) such as substantially triangular, square, pentagonal, hexagonal, heptagonal, octagonal, or other polygonal cross sections, may be elliptical or partially rounded, or may have irregular or fanciful cross sections.

As shown in FIGS. 1-4, bulk fluids plate 100 comprises a sample reservoir unit 150 that is configured to receive, retain, and dispense a volume of a sample. Sample reservoir unit 150 is bounded by a removable sample input cap 151, a sample input channel 152, and a sample blister 153. In the illustrated embodiment, sample input port 155 is disposed on top of bulk fluids plate 100 and comprises a sample input channel 152, which through bulk fluids plate 100. Sample input cap 151 is coupled to a sample input port 155, such as with a Luer lock connection. Sample blister 153 is coupled to the underside of bulk fluids plate via an adhesive layer 141.

Bulk fluids plate 100 also comprises a sample control reservoir 160 (see FIG. 4) within a sample control barrel 162, the sample control reservoir 160 being configured to retain a sample control (such as a lyosphere, not pictured). Frangible lysis blister 161 is located adjacent to sample control reservoir 160 such that tab 163 of lysis blister 161 is above sample control reservoir 160 and between locating features 188. Tab 163 seals the tops of the sample control reservoir 160 such that the sample control lyosphere is retained within it. In certain embodiments, frangible lysis blister 161 comprises about 0.5 mL of lysis buffer. In the embodiment shown, when frangible lysis blister 161 is actuated, fluid within the blister is configured to rehydrate the sample control in sample control reservoir 160.

Sample control reservoir 160 is in fluid communication with sample reservoir 150 through lysis channel 165 and lysis port 167. Lysis channel 165 is sealed by blister layer 130.

As shown in FIGS. 1-6 bulk fluids plate 100 further comprises a sample dispensing gutter 193 and a sample dispensing barrel 119 comprising a sample dispensing channel 192. Sample dispensing gutter 193 is sealed by blister layer 130 and is in fluid communication with sample reservoir 150 via proximal port 194. Sample dispensing gutter 193 is in fluid communication with sample dispensing channel 192. Sample dispensing channel 192 is sealed by a pierceable sample seal 309 coupled to barrel 119. In the embodiment shown in FIGS. 1, 2, and 4-6, fluid is configured to travel from sample reservoir 150 through proximal port 194, through sample dispensing gutter 193, and to sample dispensing channel 192. When pierceable sample seal 309 is pierced, fluid is allowed to selectively flow to the PCB.

Fluid storage container 10 further comprises a plurality of reagent reservoirs. The illustrated embodiment comprises a first reagent reservoir unit 101, a second reagent reservoir unit 102, a third reagent reservoir unit 103, a fourth reagent reservoir unit 104, a fifth reagent reservoir unit 105, a sixth reagent reservoir unit 106, a seventh reagent reservoir unit 107, and an eighth reagent reservoir unit 108. Fluid storage container 10 may comprise a greater or fewer number of reagent reservoirs units in other embodiments depending on the assay parameters. Note that the term "reagent reservoir unit" and related terms are not strictly limited to reservoir units that contain reagents, which are substances for use in a chemical reaction; other fluids used in assay preparation may be contained within reagent reservoirs, such as oils that are used to displace air from cartridge 20.

Figure 5:
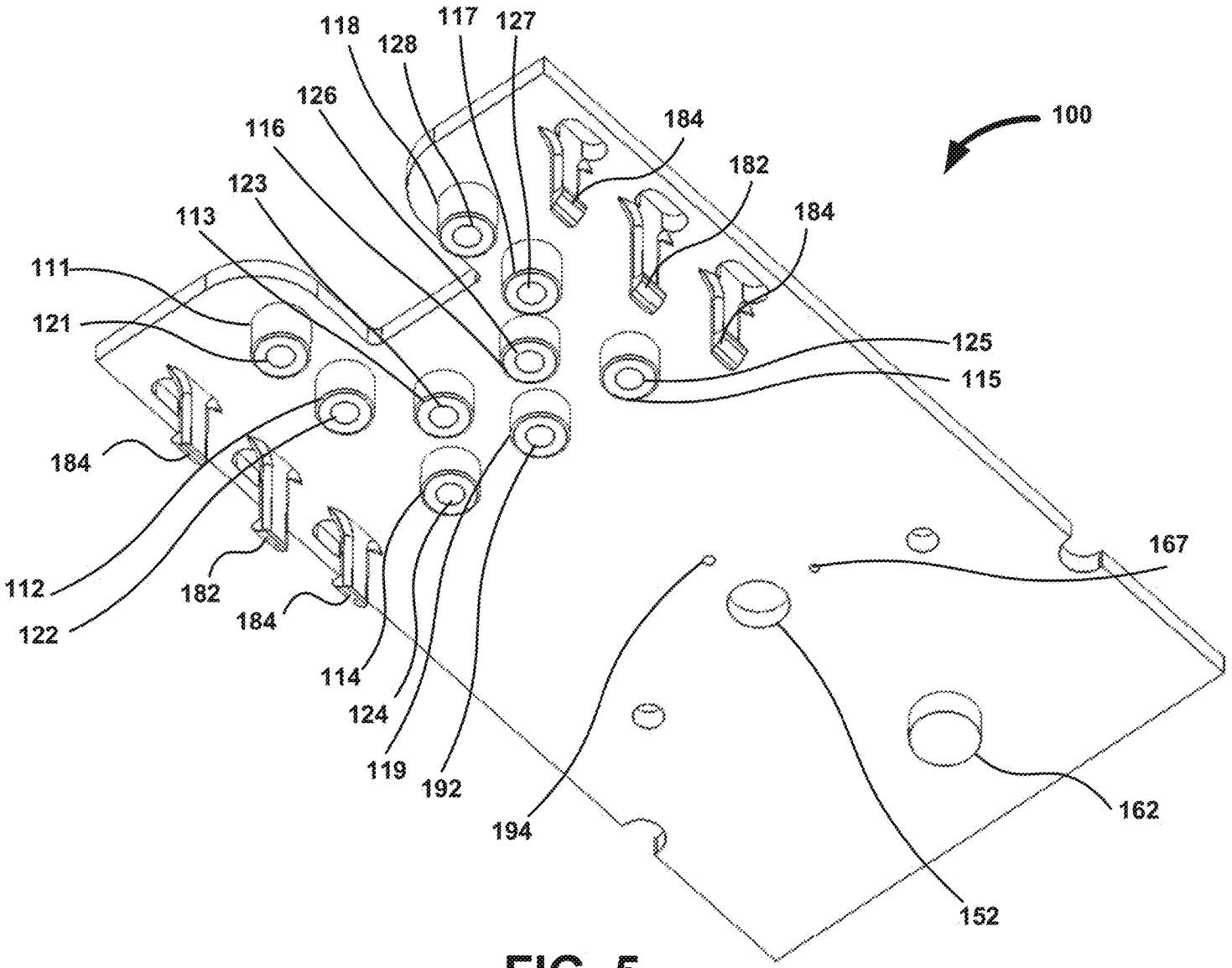
FIG. 5 is a bottom perspective view of an embodiment of a bulk fluids plate with pierceable seals removed.
Figure 6:
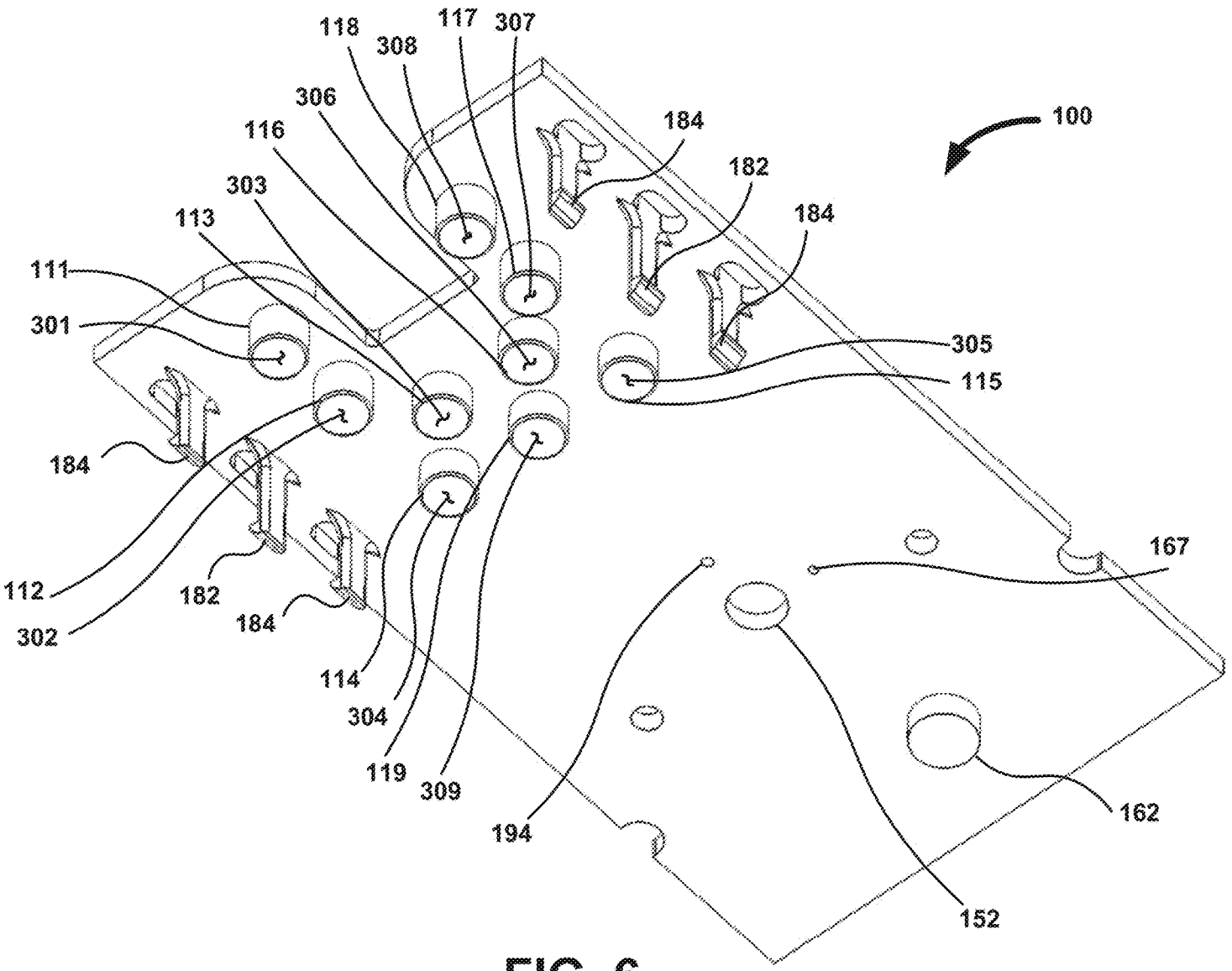
FIG. 6 is a bottom perspective view of an embodiment of a bulk fluids plate with pierceable seals shown.
Figure 7:
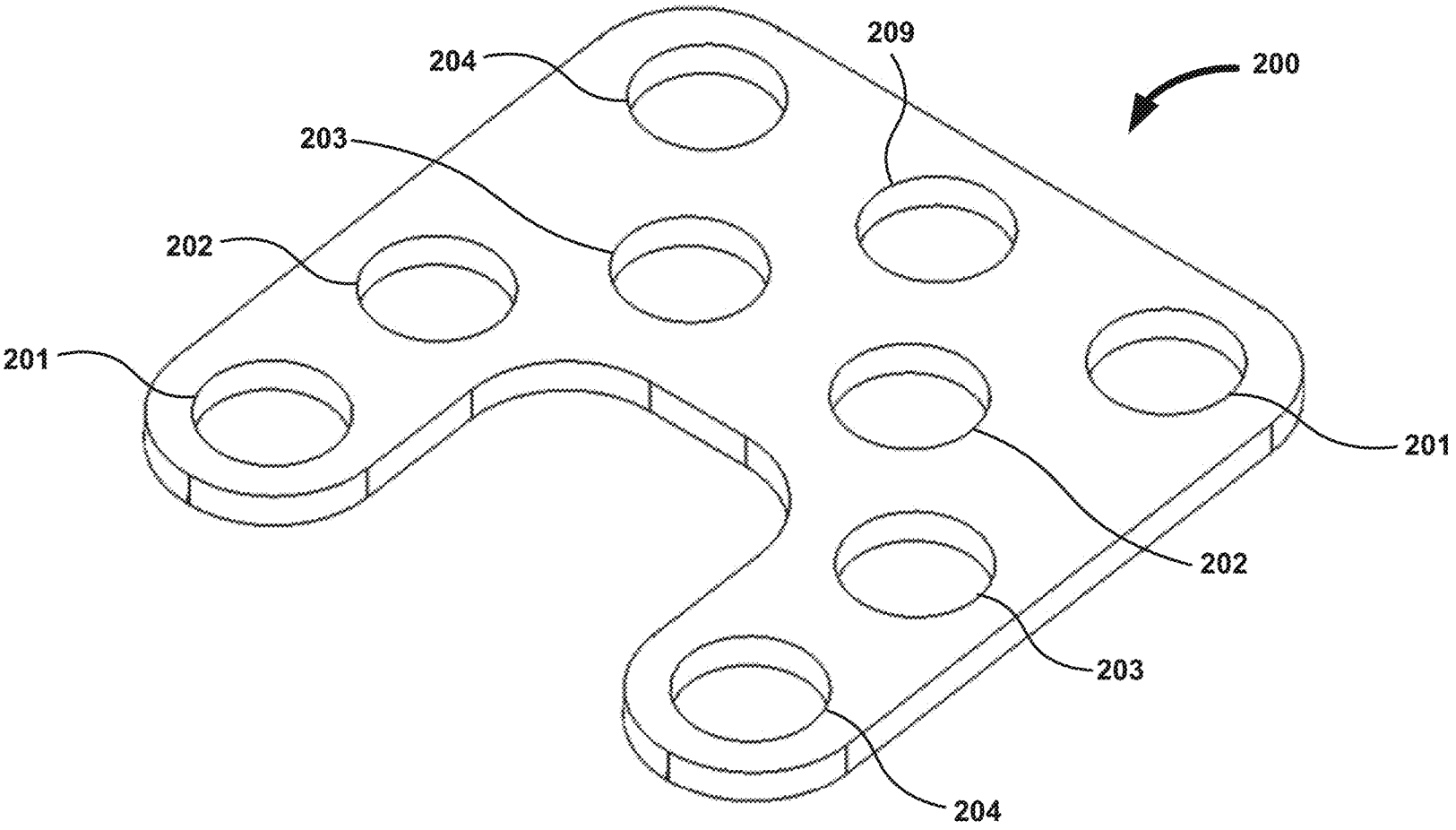
FIG. 7 is a top perspective view of an embodiment of a gasket.

In the illustrated embodiment, each reagent reservoir is a sealed space defined by a barrel comprising a reagent channel, the channel being sealed at the bottom end by a pierceable seal and sealably covered at the top by a flexible blister. Barrels are located on the bottom side of bulk fluids plate 100 (see FIGS. 5 and 6), while flexible blisters and blister layer 130 are located at the top side of bulk fluids plate 100 (shown in FIG. 4). Accordingly, as shown in FIGS. 5 and 6 and in the cross section detail of FIGS. 10A and 10B, first reagent reservoir unit 101 comprises first barrel 111 comprising a first reagent channel 121, a first pierceable seal 301 coupled to the first barrel, and a first flexible blister 131 in fluid communication with first channel 121. In the illustrated embodiment, each flexible seal is located at the distal end of each barrel. In other embodiments, each flexible seal may be located within each barrel.

The other reagent reservoirs comprise similar features and are configured in a similar manner. Second reagent reservoir unit 102 comprises second barrel 112 comprising a second reagent channel 122, a second pierceable seal 302 coupled to second barrel 112, and a second flexible blister 132 covering second reagent channel 122. Third reagent reservoir unit 103 comprises third barrel 113 comprising a third reagent channel 123, a third pierceable seal 303 coupled to third barrel 113, and a third flexible blister 133 covering third reagent channel 123. Fourth reagent reservoir unit 104 comprises fourth barrel 114 comprising a fourth reagent channel 124, a fourth pierceable seal 304 coupled to fourth barrel 114, and a fourth flexible blister 134 covering fourth reagent channel 124. Fifth reagent reservoir unit 105 comprises fifth barrel 115 comprising a fifth reagent channel 125, a fifth pierceable seal 305 coupled to fifth barrel 115, and a fifth flexible blister 135 covering fifth reagent channel 125. Sixth reagent reservoir unit 106 comprises sixth barrel 116 comprising a sixth reagent channel 126, a sixth pierceable seal 306 coupled to sixth barrel 116, and a sixth flexible blister 136 covering sixth reagent channel 126. Seventh reagent reservoir unit 107 comprises seventh barrel 117 comprising a seventh reagent channel 127, a seventh pierceable seal 307 coupled to seventh barrel 117, and a seventh flexible blister 137 covering seventh reagent channel 127. Eighth reagent reservoir unit 108 comprises eighth barrel 118 comprising an eighth reagent channel 128, an eighth pierceable seal 308 coupled to an eighth barrel 118, and an eighth flexible blister 138 covering eighth reagent channel 128.

In a specific embodiment, first reagent reservoir unit 101 comprises about 70 uL of an imaging dilution buffer; second reagent reservoir unit 102 comprises about 70 uL of a wash buffer; third reagent reservoir unit 103 comprises about 70 uL of binding beads; fourth reagent reservoir unit 104 comprises about 0.6 mL of oil; fifth reagent reservoir unit 105 comprises about 0.5 mL of oil; sixth reagent reservoir unit 106 comprises about 280 uL of binding buffer; seventh reagent reservoir unit 107 comprises about 70 uL of wash buffer; and eighth reagent reservoir unit 108 comprises about 70 uL of rehydration buffer. In other embodiments, reagent reservoir units may comprise other fluids useful in performing a fluid assay. In addition, other embodiments may comprise reagent reservoirs capable of containing a larger or smaller volume of fluid. In specific embodiments, no reagent reservoir unit is configured to contain about (and in more specific embodiments, no more than) 2 mL of fluid. In other specific embodiments, each reagent reservoir unit is configured to contain more than about (and, in more specific embodiments, more than) 20 uL of fluid.

As shown in FIGS. 1-6, bulk fluids plate 100 further comprise pairs of tabs located on opposite sides of the plate. In the embodiment shown, there are two fastening tabs 182 and four engagement tabs 184. Fastening tabs 182 are longer than the engagement tabs 184 to facilitate securing fluid storage container 10 to analysis cartridge 20 in two stages. The fastening tabs 182 and the engagement tabs 184 are paired in the illustrated embodiment, but may be not paired in other embodiments.

As shown in FIGS. 1, 2, 3, and 7, the illustrated embodiment of fluid storage container 10 further comprises a gasket 200. In the illustrated embodiment, gasket 200 comprises a plurality of holes 201-209. Each hole is configured to receive a corresponding barrel located on bulk fluids plate 100. Accordingly, first hole 201 is configured to receive first barrel 111; second hole 202 is configured to receive second barrel 112; third hole 203 is configured to receive third barrel 113; fourth hole 204 is configured to receive fourth barrel 114; fifth hole 205 is configured to receive fifth barrel 115; sixth hole 206 is configured to receive sixth barrel 116; seventh hole 207 is configured to receive seventh barrel 117; eighth hole 208 is configured to receive eighth barrel 118; and ninth hole 209 is configured to receive sample dispensing barrel 119. In specific embodiments, gasket 200 may be overmolded to bulk fluids plate 100.

In other embodiments not shown, a plurality of gaskets may be provided, such as equal in number to and corresponding to each barrel of bulk fluids plate 100.

FIGS. 11-19 illustrate an additional embodiment of a system 445 that can be used for fluid assay analysis. In this embodiment, system 445 comprises a fluid storage container 410, as well as other components described more fully below. In this embodiment fluid storage container 410 is comprised of a bulk fluids plate 427 with a syringe barrel array 490, a plurality of pistons 431-436, sample input caps 438, 439, pierceable seals 419, and a gasket 485. Instead of blisters, this embodiment employs pistons 431-436 to provide the positive displacement used to transfer the reagents and other fluids from fluid storage container 410 to an analysis cartridge 420, described more fully below. This embodiment also utilizes coupling members 475, 465 to apply the mechanical force required to maintain a substantial seal between fluid storage container 410 and analysis cartridge 420 during fluid dispense.

Analysis Cartridge

As shown in FIGS. 1-3 and 8-10B, analysis cartridge 20 comprises a retention plate 500 configured to be coupled to bulk fluids plate 100. In the embodiments shown, retention plate 500 is configured to retain an assay surface, such as PCB 800, on the bottom side of retention plate 500. In some embodiments, PCB 800 may comprise an electrowetting surface, one or more heating elements, one or more microchannels, or some combination of these features.

In the illustrated embodiment of FIGS. 1-10B, retention plate 500 comprises a plurality of slots 510 that are configured to receive fastening tabs 182 and engagement tabs 184 of bulk fluids plate 100.

The embodiment shown in FIGS. 11-19 utilizes a different configuration for retention plate 470. In this embodiment, retention plate 470 comprises a pair of threaded holes 471, 472 into which coupling members 475, 476 are inserted.

Referring back to the embodiment of FIGS. 1-10B, retention plate 500 further comprises bosses protruding from its top side that correspond to and are configured to sealably mate with the barrels of container 10. In the illustrated embodiment, the bosses are configured to receive the barrels of container 10. The bosses may be characterized as protrusions in various embodiments. Each boss (discussed with reference to FIG. 8 below) comprises a floor configured to limit the travel of its corresponding barrel of container 10 and a piercing element, such as a lance, disposed on and extending from the floor. In the illustrated embodiment, the lances are depicted as pointed or sharp. However, in other embodiments the piercing elements may be blunted, rounded, or flat-topped. Each piercing element is configured to pierce a corresponding seal located on a barrel of container 10.

Furthermore, in the illustrated embodiment, the bosses are depicted as being substantially cylindrical in shape; in other words, the bosses have a substantially circular cross section. In other embodiments the bosses may not be cylindrical and may have substantially triangular, square, pentagonal, hexagonal, heptagonal, octagonal, or other polygonal cross sections, may be elliptical or partially rounded, or may have irregular cross sections. Each boss and corresponding barrel is configured to sealably mate with each other such that liquid can move from the barrel to the boss with substantially no liquid leaking out. In the depicted embodiment, this configuration is achieved by the boss having a chamber configured to receive a barrel. In other embodiments, this could also be achieved by the barrel having a channel that is configured to receive a boss. In at least some such other embodiments, the top edge of the boss could act as a piercing element (and thus would be one example of a piercing element associated with the boss), and the bottom of the boss's chamber could comprise a conduit through which liquid may pass that enters the chamber after flowing from the pierced barrel; in at least some other such embodiments, the boss could include a piercing element that extends upwardly from the bottom of the boss chamber to a location above the top edge of the boss (such a piercing element being yet another example of a piercing element associated with the boss), such that the piercing element is the first structure of the boss to contact the pierceable seal of the barrel. In embodiments where the barrel is configured to receive the boss, the shapes of the barrel channel and the outside of the boss could each be tapered and configured to fit tightly against each other to effect a substantial seal (where such taper decreases in size as the relevant protrusion extends from the relevant plate).

Figure 8:
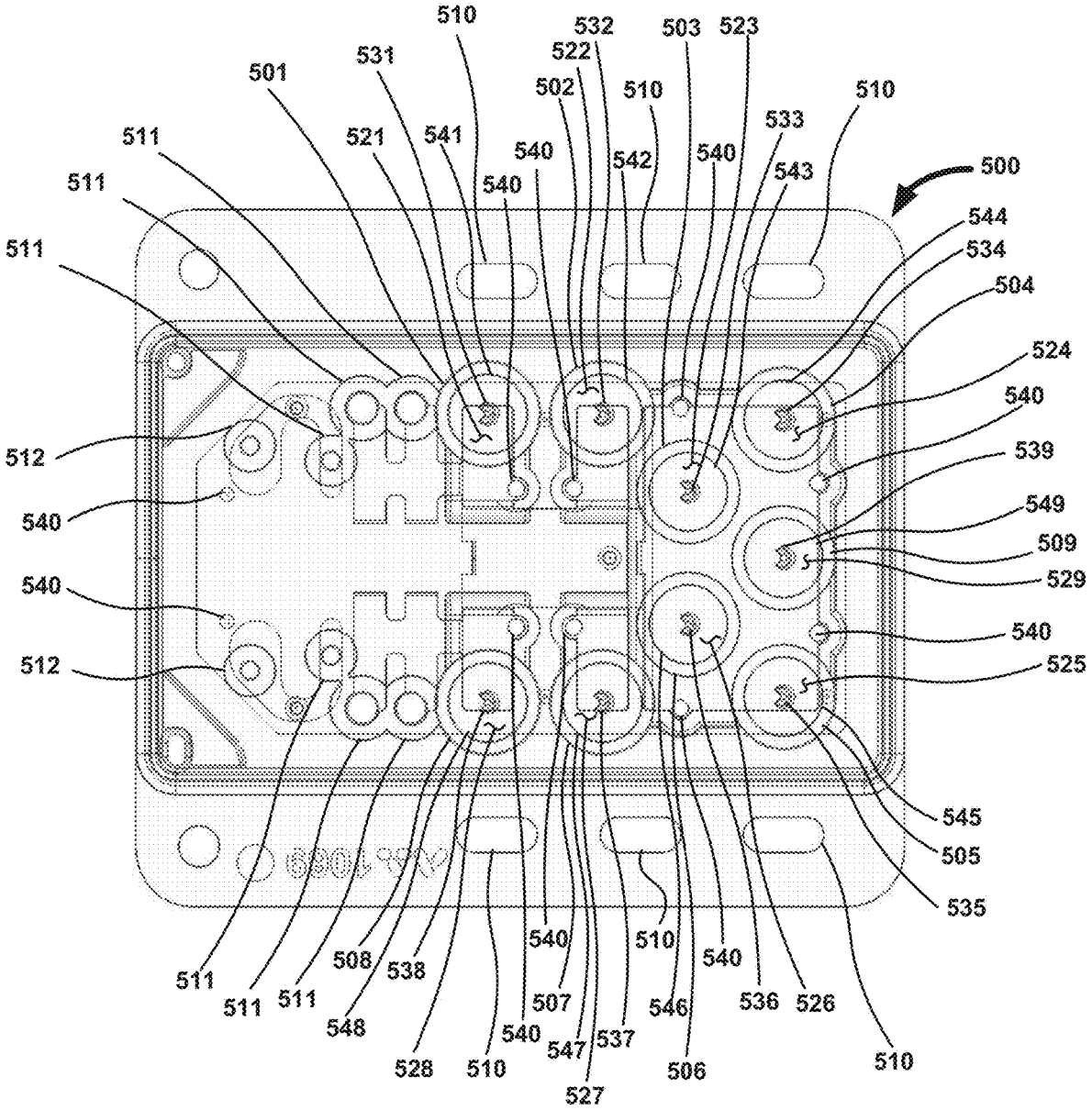
FIG. 8 is a top view of an embodiment of a retention plate.
Figure 9:
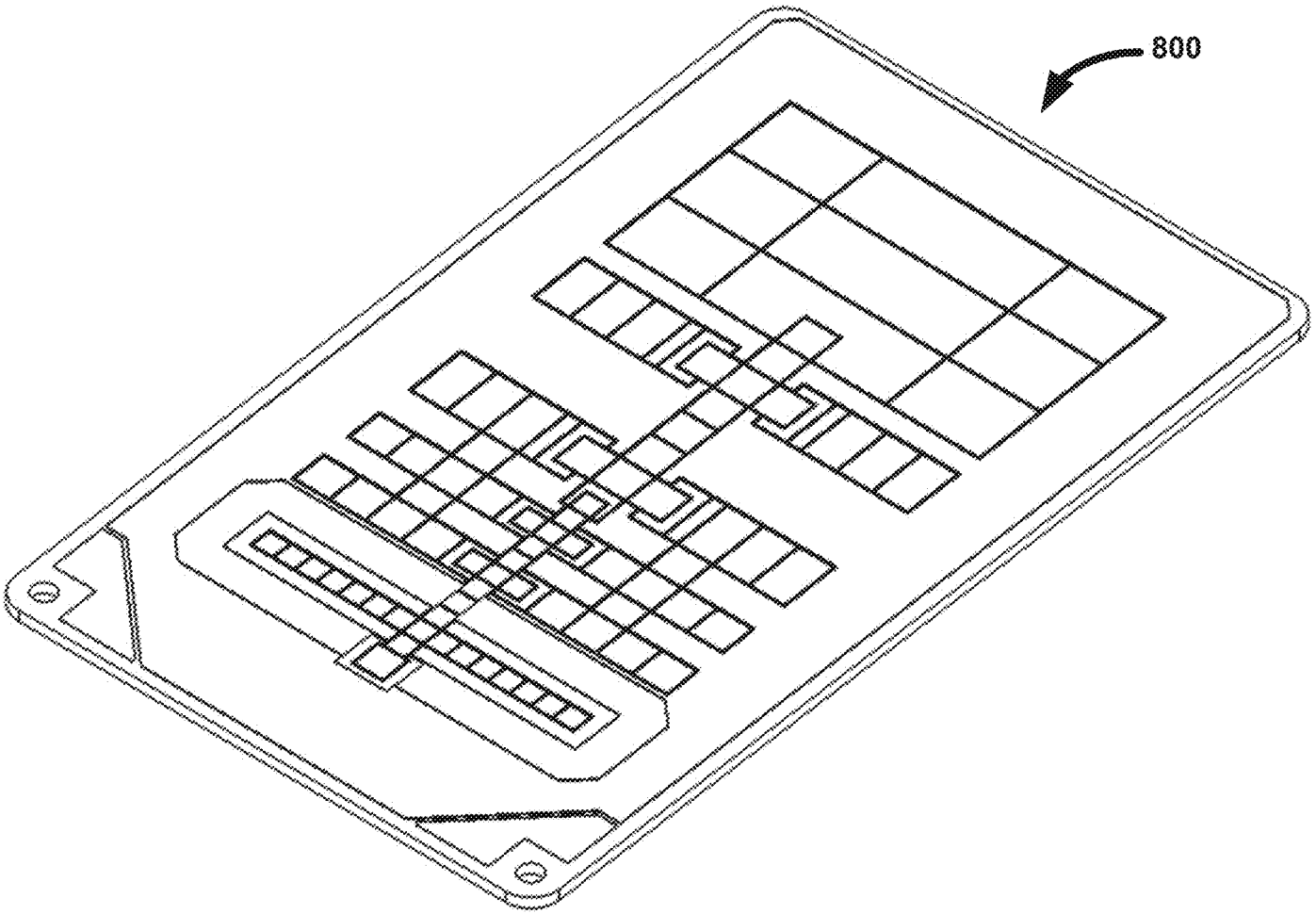
FIG. 9 is a perspective view of embodiments of a PCB.

In the illustrated embodiment, there are nine bosses that correspond to nine barrels—the eight reagent barrels 101-108 and one sample input barrel 109 of container 10. As shown in FIG. 8, first boss 501 comprises a first chamber 541 having a first floor 521 and a first lance 531, which extends upward from the first floor and is a feature shared by each of the floors and lances discussed herein. Second boss 502 comprises a second chamber 542 having a second floor 522 and a second lance 532. Third boss 503 comprises a third chamber 543 having a third floor 523 and a third lance 533. Fourth boss 504 comprises a fourth chamber 544 comprising a fourth floor 524 and a fourth lance 534. Fifth boss 505 comprises a fifth chamber 545 having a fifth floor 525 and a fifth lance 535. Sixth boss 506 comprises a sixth chamber 546 having a sixth floor 526 and a sixth lance 536. Seventh boss 507 comprises a seventh chamber 547 having a seventh floor 527 and a seventh lance 537. Eighth boss 508 comprises an eighth chamber 548 having an eighth floor 528 and an eighth lance 538. Ninth boss 509 comprises a ninth chamber 549 having a ninth floor 529 and a ninth lance 539.

Figure 10B:
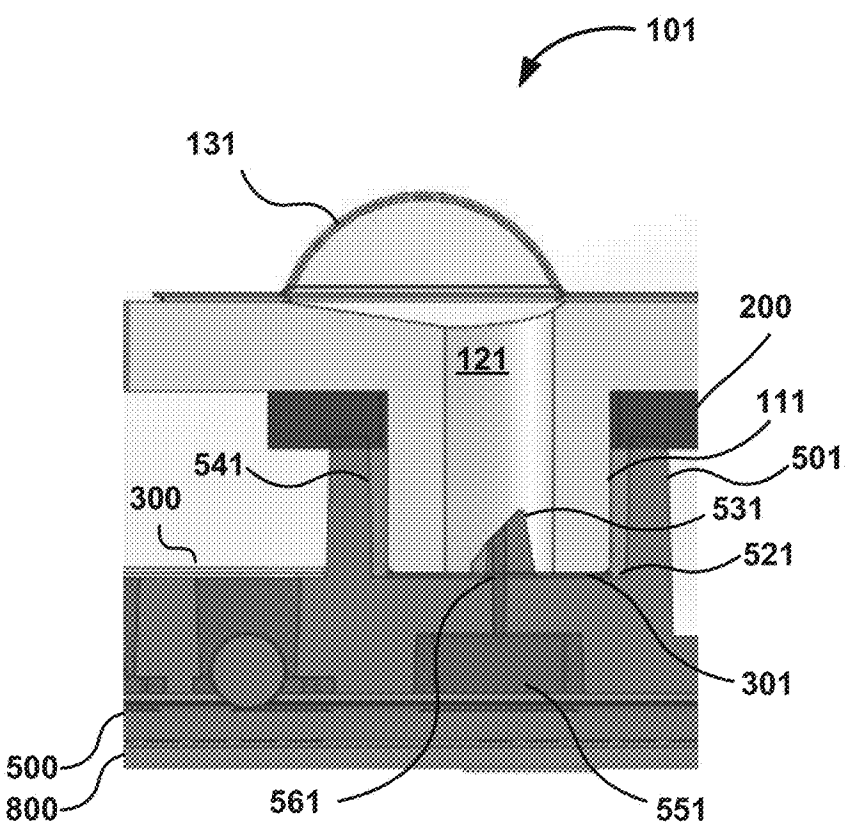
FIG. 10B is a side section view of embodiments of fluid storage container coupled to analysis cartridge at the engaged stage
Figure 10A:
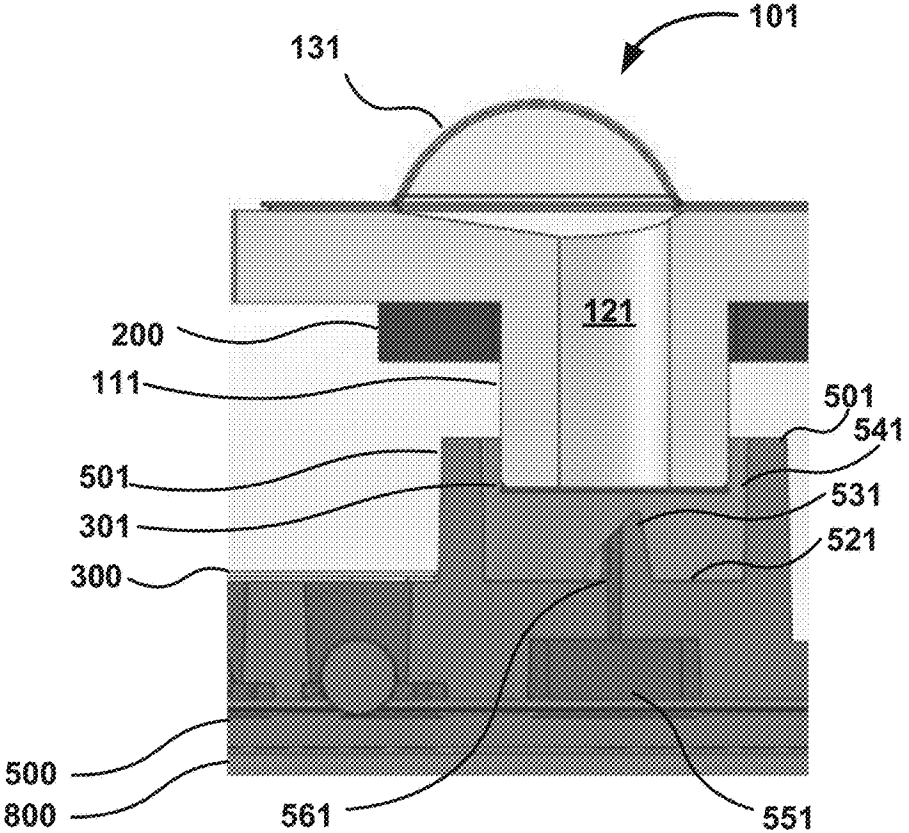
FIG. 10A is a side section view of embodiments of fluid storage container coupled to analysis cartridge at the fastened stage.
Figure 11:
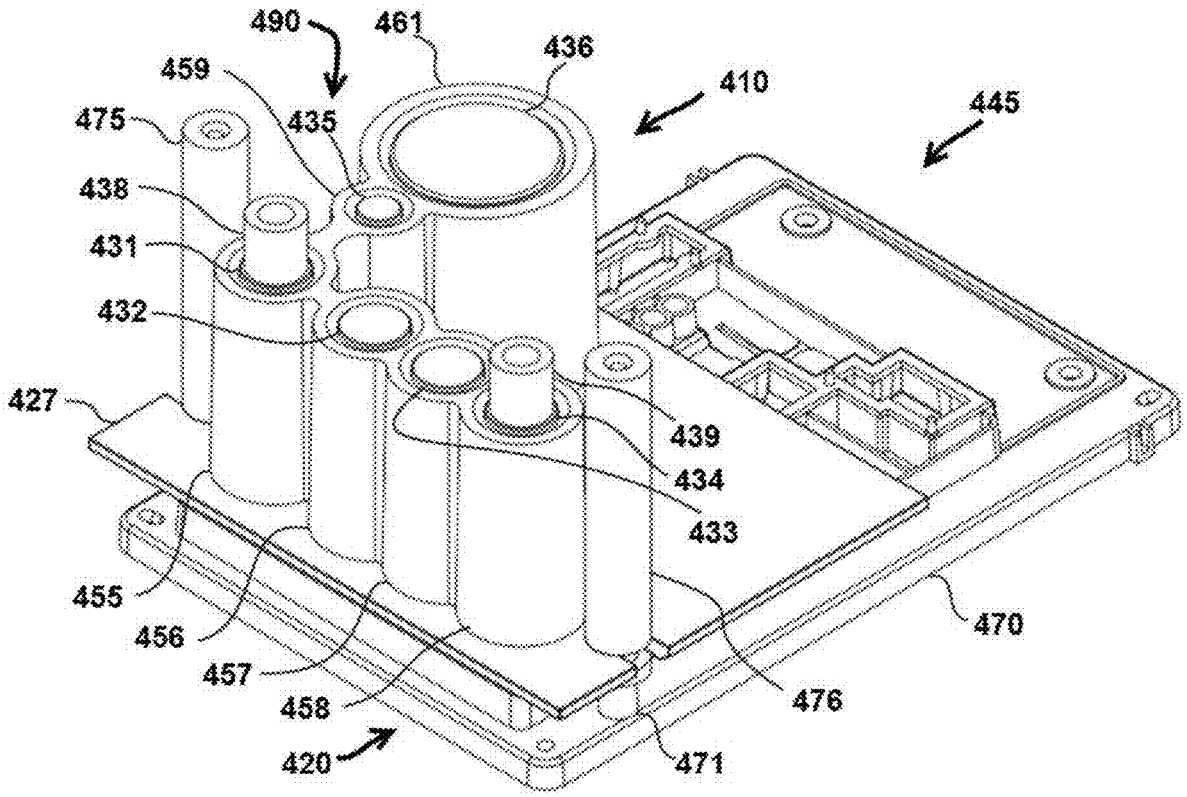
FIG. 11 is a top perspective view of embodiments of an assembly of a fluid storage container and an analysis cartridge.
Figure 12:
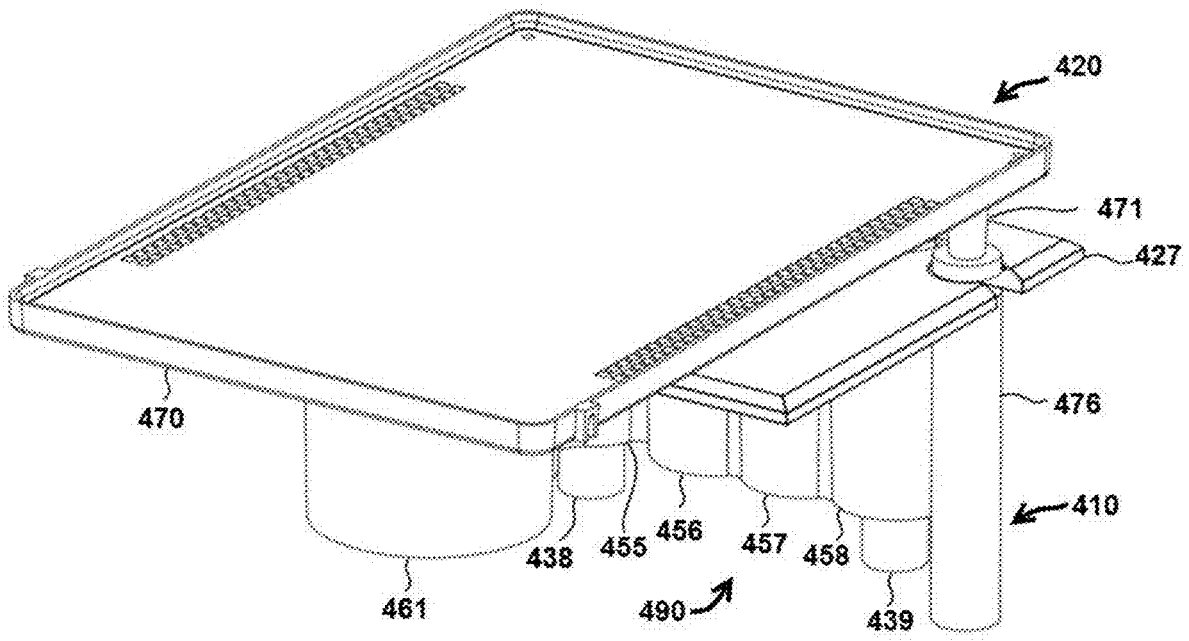
FIG. 12 is a bottom perspective view of embodiments of an assembly of a fluid storage container and an analysis cartridge.
Figure 13:
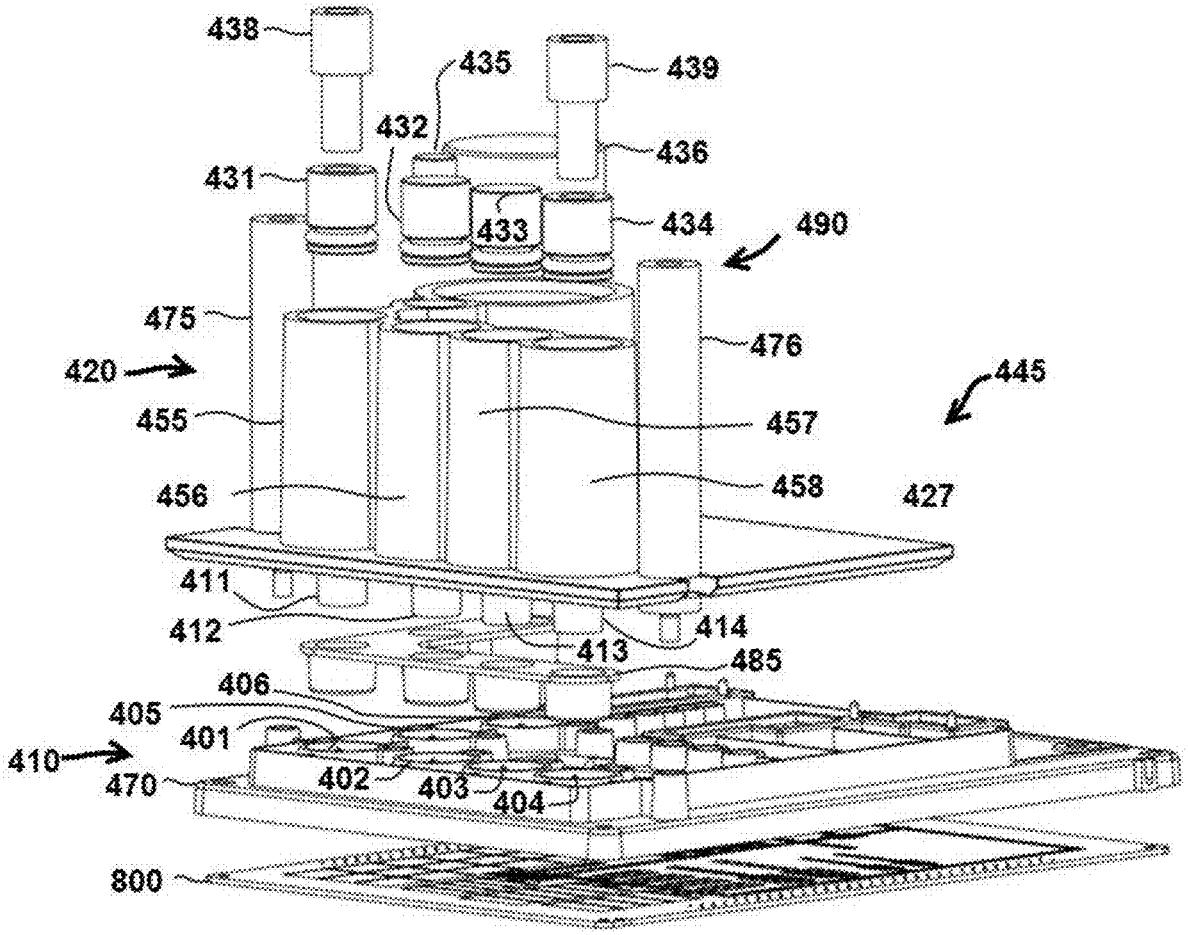
FIG. 13 is an exploded view of embodiments of a fluid storage container and an analysis cartridge.
Figure 14:
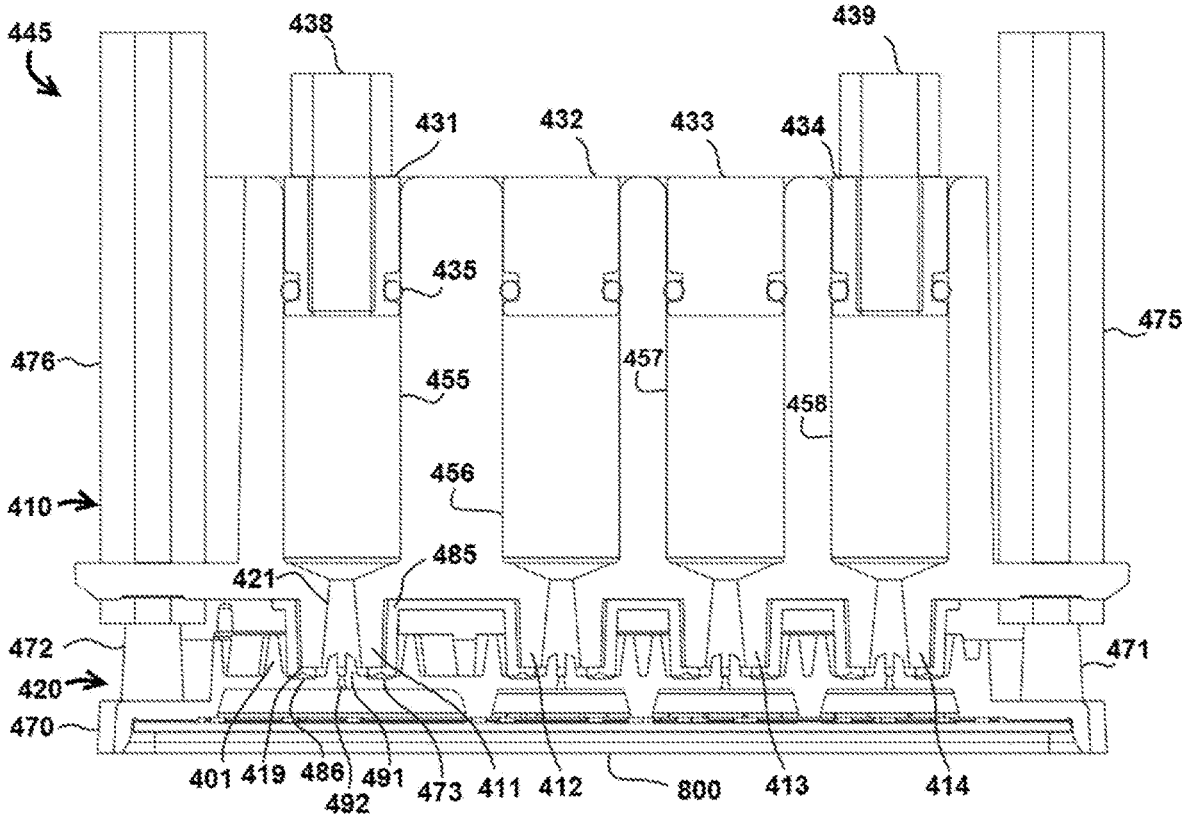
FIG. 14 is a side section view of embodiments of a fluid storage container and an analysis cartridge.
Figure 15:
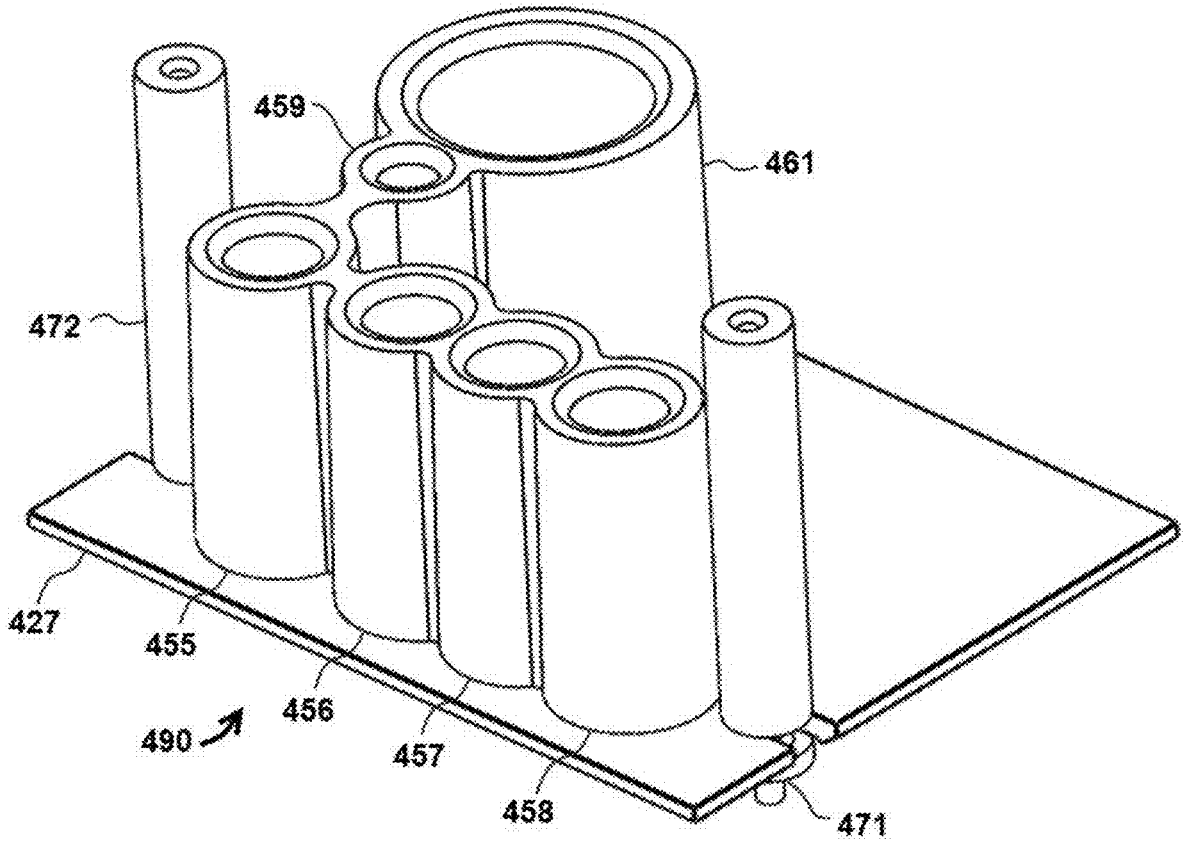
FIG. 15 is a top perspective view of an embodiment of a bulk fluids plate.

A cross section detail view of an embodiment of first boss 501 is shown in FIGS. 10A and 10B. In the embodiments shown, first lance 531 is a configured to pierce seal 301 of first barrel 101. In preferred embodiments first lance 531 is about 0.150" tall (that is, the distance from floor 521 to tip of lance 531 is about 0.150"). In other embodiments, first lance 531 may be between about 0.150" and about 0.250" tall. First lance 531 comprises a first conduit 561 in fluid communication with first dispensing reservoir 551. First conduit 561 is an example of a channel in (fluid) communication with first boss 501. First dispensing reservoir 551 is configured to deliver a volume of fluid to PCB 800. Other bosses 502-509, lances 532-539, and dispensing reservoirs 552-559 comprise similar features that function in a similar manner, which can be understood by a person of ordinary skill who refers to these figures. First lance 531 is an example of a piercing element associated with boss 501.

The illustrated embodiment of analysis cartridge 20 further comprises a plurality of oil-loading bosses 512 that are configured to be in fluid communication with PCB 800 and through which oil may be delivered to PCB 800. The illustrated embodiment of analysis cartridge 20 also comprise liophylized reagent bosses 511 that are configured to be in fluid communication with PCB 800 and through which liophylized reagent may be delivered to PCB 800.

In the illustrated embodiment, retention plate 500 further comprises a plurality of vents 540 in fluid communication with PCB 800 and configured to vent gas, such as air from PCB 800 during use. Vents 540 are covered with membrane 300 which is configured to allow air to pass but not liquid. In the illustrated embodiment, membrane 300 is an adhesive-backed Versapor 800 hydrophobic nylon mesh.

Embodiments of the Present Systems and Methods

Embodiments of the present methods of using the illustrated embodiment of container 10 and cartridge 20 will be discussed with reference to FIGS. 1, 2, 10A and 10B.

In certain embodiments, sample input cap 151 may be removed from container 100 and a liquid sample introduced through sample input channel 152 into sample blister 153. Sample input cap 151 may then be replaced. In certain embodiments, sample input cap 151 may be removed and replaced manually by a user; in other embodiments, sample input cap 151 may be removed and replaced in an automated fashion.

Container 10 may be coupled to cartridge 20 by aligning fastening tabs 182 and engagement tabs 184 of container 10 with slots 580 on cartridge 20. In a fastening step, force is applied to container 10, cartridge 20, or both, such that fastening tabs 182 slide into the corresponding slots 580 and container 10 is fastened to cartridge 20. Engagement tabs 184 remain outside their corresponding slots 580 and are not directly engaged with cartridge 20. None of the pierceable seals are pierced. This is known as the first stage, the first state, the fastened stage, or the fastened state.

As shown in FIG. 10A, at the fastened stage, the lances have not pierced the seals of the corresponding barrels. However, barrel 111 has begun to engage boss 501.

In an engaging step, further force is applied to container 10, cartridge 20, or both, such that engagement tabs 184 slide into the corresponding slots 580. This is known as the second stage, the engaged stage, the second state, or the engaged state.

As shown in FIG. 10B, at the engaged stage, the lances have pierced the seals of the barrels. For example, first lance 531 has pierced the seal 301 located on first barrel 111. At the engaged stage, first barrel 111 has traveled such that it is adjacent to and contacting first floor 521 of first boss 501. Gasket 200 has traveled such that it is adjacent to and sealably contacting a portion of boss 501. In the engaged state, system 5 is configured such that gasket 200 will prevent substantially any fluid from leaking out of container 10 or cartridge 20. More specifically, such a configuration is achieved at least in part by the configuration of first barrel 111 contacting first floor 521, first lance 531 being inside first reagent channel 121 such that first conduit 561 is in fluid communication with first reagent reservoir 101, and first gasket 200 sealably engaging a portion of first barrel 111 and first boss 501 such that substantially any fluid is prevented from leaking out of container 10 or cartridge 20 (that is, a substantially leak-proof seal is formed between container 10 and cartridge 20).

In certain embodiments, the fastening step may be accomplished manually while the engaging step may be performed by an analysis device configured to receive container 10 and cartridge 20. In other embodiments, both the fastening and engaging steps may be performed by an analysis device configured to receive container 10 and cartridge 20. In still other embodiments, both the fastening step and the engaging step may be performed manually.

In a preferred embodiment, container 10 and cartridge 20 are introduced into an instrument at the fastened stage. For example, the instrument may comprise a Luminex MAG-PIX® multiplexing platform (available from Luminex Corp., Austin, Tex.), though other suitable multiplexing or assay preparation instruments may be used.

Once introduced into the instrument, force is applied to container 10, cartridge 20, or both such that container 10 and cartridge 20 are in the engaged stage such that each lance 531-539 pierces the foil 301-309 on the corresponding barrel 111-119.

Frangible lysis blister 161 is actuated, releasing the lysis buffer contained within. The lysis buffer rehydrates the sample control located in sample control reservoir 160. In addition, the lysis buffer travels into sample reservoir 150, lysing the sample.

In some embodiments, fourth flexible blister 134 and fifth flexible blister 135 are actuated, which dispense the oil contained within fourth reagent reservoir 134 and fifth reagent reservoir 135 to cartridge 20, thereby displacing any air contained within cartridge 20.

Then, in some embodiments, first flexible blister 131, second flexible blister 132, third flexible blister 133, sixth flexible blister 136, seventh flexible blister 137, and eighth flexible blister 138 are actuated to dispense the fluid contained within each of the corresponding reagent reservoirs 101, 102, 103, 106, 107, and 108 to dispensing reservoirs 531, 532, 533, 536, 537, and 538 in cartridge 20.

In some embodiments, sample blister 153 is then engaged, distributing the lysed sample through sample dispensing channel 192 to cartridge 20.

These steps may be performed in the order listed in some embodiments, but may not be in other embodiments. Moreover, in other embodiments, not all the steps discussed above are performed. For example, fewer than all flexible blisters may be actuated.

An alternative embodiment comprising system 445 including fluid storage container 410 and analysis cartridge 420 will be discussed further with reference to FIGS. 11-19.

Figure 18:
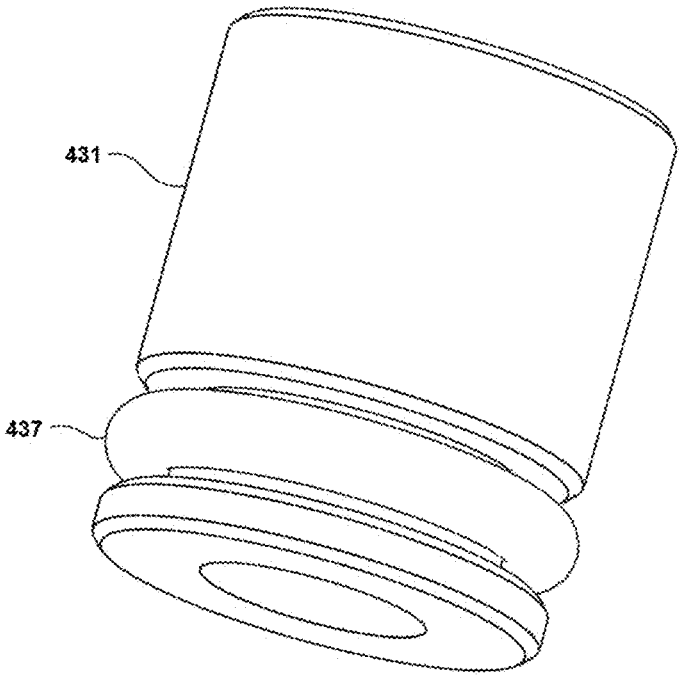
FIG. 18 is a bottom perspective view of an embodiment of a fluid displacement mechanism.

In the embodiment shown, sample input caps 438, 439 may be removed from pistons 431, 434 and a liquid sample introduced into the sample reservoirs 451 and 454. In certain embodiments, sample input caps 438 and 439 may be removed and replaced manually by a user; in other embodiments, sample input caps 438, 439 may be removed and replaced in an automated fashion. As shown in FIG. 18, piston 431 may comprise a seal 437 extending around the circumference of piston 431. In certain embodiments, seal 437 may be an elastomer seal, and in specific embodiments, seal 437 may be configured as an O-ring.

Container 410 may be coupled to cartridge 420 by aligning coupling members 475, 476 on container 410 to threaded holes 471, 472 on cartridge 420. In a fastening step, torque can be applied to coupling members 475, 476 to thread coupling members 475, 476 into threaded holes 471, 472. In this scenario seals 419 (also visible in FIG. 17) are pierced as assembled in FIG. 14. Additionally gasket 485 has traveled such that it is adjacent to and sealably contacting a raised feature 486 on the floor of the cartridge 420.

Figure 19:
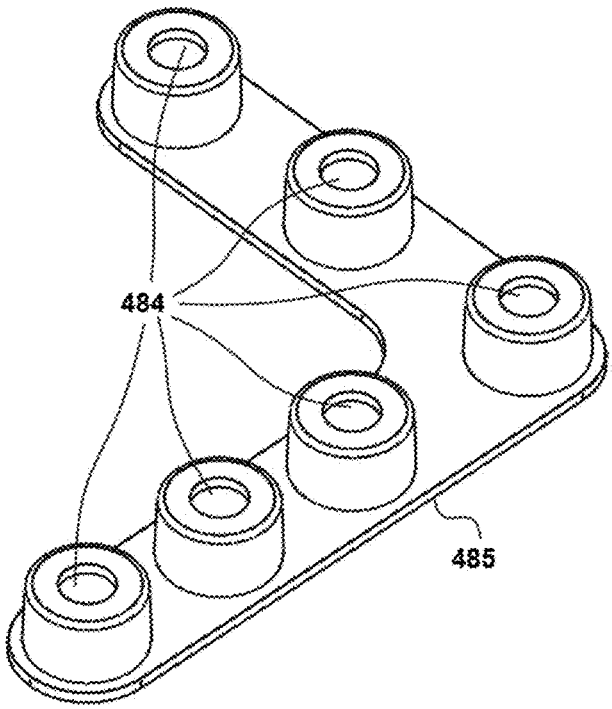
FIG. 19 is a top perspective view of an embodiment of a gasket.

In this state, system 445 is configured such that gasket 485 will prevent substantially any fluid from leaking out of container 410 or cartridge 420. More specifically, such a configuration is achieved at least in part by the configuration of first protrusion 411 contacting first floor 473, first lance 491 being inside first reagent channel 421 such that first conduit 492 is in fluid communication with sample reservoir 455, and 485 sealably engaging a portion of first protrusion 411 and first boss 401 such that substantially any fluid is prevented from leaking out of container 410 or cartridge 420 (that is, a substantially leak-proof seal is formed between container 410 and cartridge 420). Also shown are second through sixth bosses 402-406, respectively, each of which engages its respective protrusion 412-416. As shown in FIG. 19, gasket 485 may comprise a plurality of apertures or holes 484 corresponding with protrusions 411-416. Apertures 484 allow first reagent channel 421 to be in fluid communication with first conduit 492 after first protrusion 411 pierces seal 419.

Figure 16:
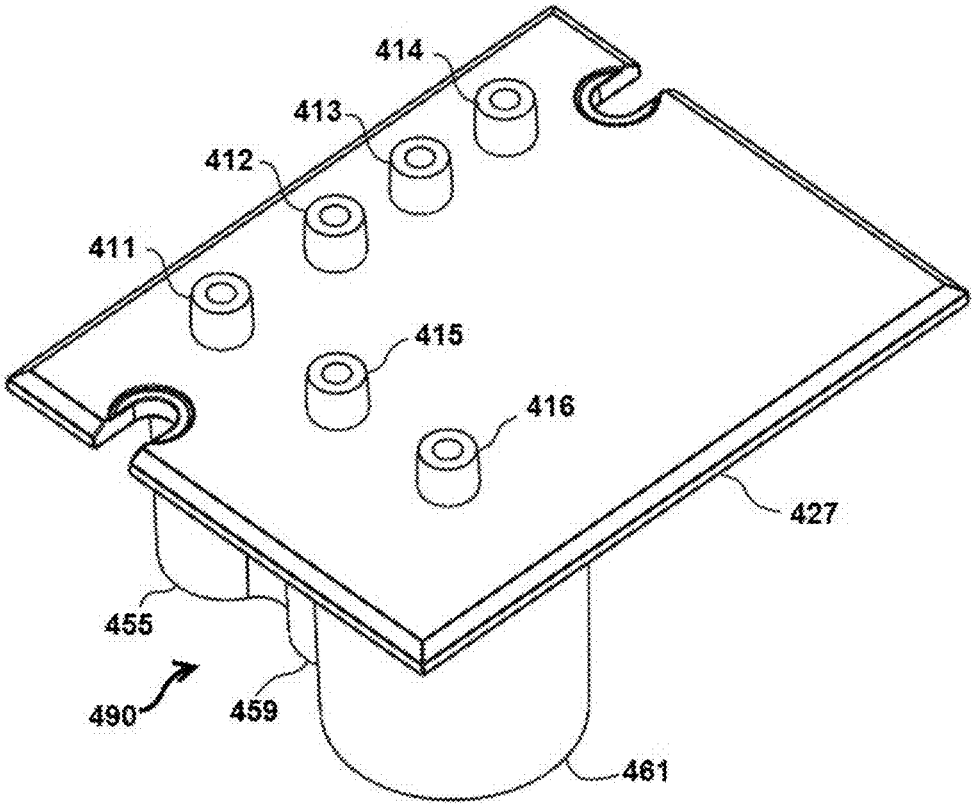
FIG. 16 is a bottom perspective view of an embodiment of a bulk fluids plate.
Figure 17:
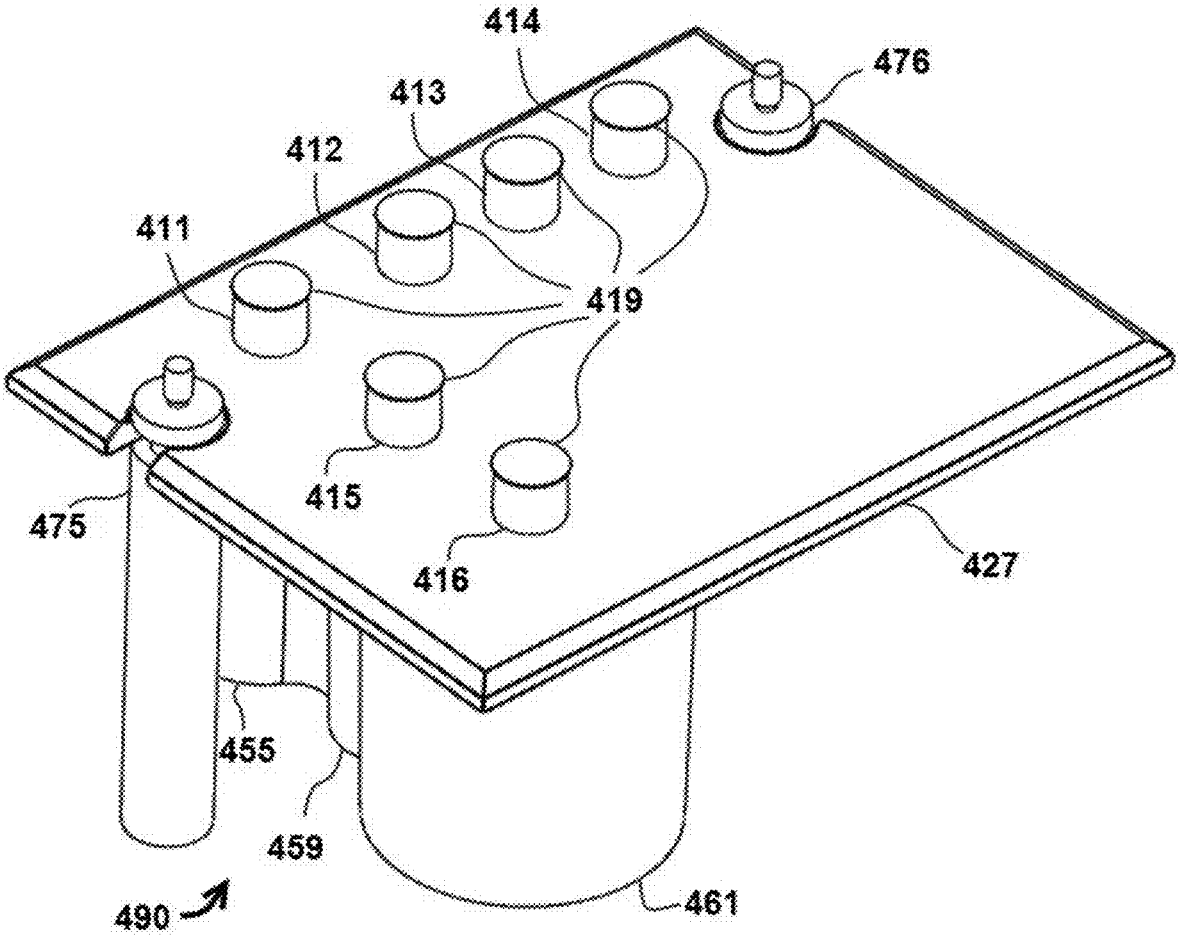
FIG. 17 is a bottom perspective view of an embodiment of a bulk fluids plate with pierceable seals shown.

Referring now to FIGS. 16 and 17, bulk fluids plate 427 is shown in an inverted perspective view. In this view, protrusions, 411-416 are visible, as well as a portion of syringe barrel array 490. In FIG. 19, pierceable seals 419 are shown coupled to protrusions 411-416. In addition, coupling members 474, 476 are also shown coupled to bulk fluids plate 427 in FIG. 19. For purposes of clarity, it is understood that not all elements are labeled in all of the figures.

In one embodiment, container 410 and cartridge 420 are introduced into an instrument at the fastened stage. For example, the instrument may comprise a Luminex MAG-PIX® multiplexing platform (available from Luminex Corp., Austin, Tex.), though other suitable multiplexing or assay preparation instruments may be used.

After container 410 and cartridge 420 are loaded into the appropriate instrument, oil piston 436 can be actuated to release oil from reservoir 461 into cartridge 420 thereby displacing air within cartridge 420.

In some embodiments, sample pistons 431 and 434 are actuated, which can dispense samples from sample reservoirs 455 and 458 into cartridge 420. In addition, pistons 432 and 433 can be actuated to dispense reagents contained within each reagent reservoirs 456 and 457 into cartridge 20. Furthermore, piston 435 can be actuated to dispense magnetic particles from reservoir 459 into cartridge 420.

These steps may be performed in the order listed in some embodiments, but may not be in other embodiments. Moreover, in other embodiments, not all the steps discussed above are performed. For example, fewer than all pistons may be actuated. It is understood that the embodiments of FIGS. 11-19 may comprise additional features equivalent to those shown and described in the discussion of the embodiments of FIGS. 1-10B.

Materials of Disclosed Embodiments

Non-limiting materials used to construct the illustrated embodiments of the present systems, containers, cartridges, and elements of these are discussed below. Other suitable materials known to a person of ordinary skill in the art may be used instead.

In the illustrated embodiment, bulk fluids plate 100 comprises polycarbonate. In other embodiments bulk fluids plate 100 may comprise other semi-rigid plastics or hard plastics, which may include polyurethanes, polyesters, epoxy resins and phenolic resins; polyethylene (PE), polypropylene (PP), polyvinyl chloride (PVC), and polyethylene terephthalate (PET or PETE). In still other embodiments, bulk fluids plate 100 may comprise one or more metals, such as aluminum.

In the illustrated embodiment, retention plate 500 comprises polycarbonate. In other embodiments retention plate 500 may comprise other semi-rigid plastics or hard plastics, which may include polyurethanes, polyesters, epoxy resins and phenolic resins; polyethylene (PE), polypropylene (PP) and polyvinyl chloride (PVC), polyethylene terephthalate (PET or PETE). In still other embodiments, retention plate 500 plate may comprise metals such as aluminum.

Frangible lysis blister 161 is a Thinxxs 500 uL frangible blister in the embodiment shown. However, lysis blister may comprise other flexible and/or frangible polymers in other embodiments.

Blister layer 130, flexible blisters 131-139, and sample blister 153 comprise LDPE in the illustrated embodiment. In other embodiments, these blisters may comprise other flexible polymers.

Adhesive layers 140 and 141 comprise adhesive transfer tape (3M, 9485PC adhesive transfer tape) in the illustrated embodiment, though other forms of adhesive may be used.

In the illustrated embodiment, gasket 200 comprises polyurethane. In specific embodiments, gasket 200 comprises a 0.06" sheet of polyurethane that has been die-cut and coupled to bulk fluids plate 100 with adhesive transfer tape. Other suitable materials for gasket 200, such as polymers, may be used.

Seals 301-309 in the illustrated embodiments comprise aluminum foil backed with bi-axially oriented polypropylene film (BOPP) (such as 0.001" aluminum foil backed with 0.002" BOPP film).

It should be understood that the present devices and methods are not intended to be limited to the particular forms disclosed. Rather, they are to cover all modifications, equivalents, and alternatives falling within the scope of the claims. For example, certain embodiments of the container 10 and cartridge 20 discussed above are shown configured for use with an assay preparation module. However, container 10 and cartridge 20 are suitable for use in any small space where precise dispensation of fluids in a specified order may be required.

The above specification and examples provide a complete description of the structure and use of an exemplary embodiment. Although certain embodiments have been described above with a certain degree of particularity, or with reference to one or more individual embodiments, those skilled in the art could make numerous alterations to the disclosed embodiments without departing from the scope of this invention. As such, the illustrative embodiment of the present devices is not intended to be limited to the particular forms disclosed. Rather, they include all modifications and alternatives falling within the scope of the claims, and embodiments other than the one shown may include some or all of the features of the depicted embodiment. For example, components may be combined as a unitary structure and/or connections may be substituted. As another example, one of ordinary skill in the art would understand that, in alternate embodiments, fastening tabs 182 and engagement tabs 184 may be located on cartridge 20 while slots 580 may be located on container 10. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not to be interpreted as including means-plus- or step-plus-function limitations, unless such a limitation is explicitly recited in a given claim using the phrase(s) "means for" or "step for," respectively.

We claim:

1. A system comprising:

(a) a first plate comprising:
- (i) a first side;
- (ii) a second side;
- (iii) a sample reservoir;
- (iv) a first port;
- (v) a channel connecting the sample reservoir and the first port;
- (vi) a sample dispensing channel opening onto the second side of the first plate, wherein the sample dispensing channel is in fluid communication with the sample reservoir;

(b) a frangible blister coupled to the first side of the plate and covering the first port;

(c) a removable sample input cap coupled to the first side of the plate and covering the sample reservoir;

(d) a second plate comprising:
- (i) a first side;
- (ii) a second side;
- (iii) a conduit passing through the second plate from the first side of the second plate to the second side of the second plate;

wherein the first side of the second plate is coupled to the second side of the first plate; and (e) a printed circuit board coupled to the second side of the second plate.

2. The system of claim 1, wherein the frangible blister contains a lysis buffer.

3. The system of claim 1, wherein the sample dispensing channel is in fluid communication with the sample reservoir via a sample dispensing gutter.

4. The system of claim 1, further comprising a gasket disposed between the second side of the first plate and the first side of the second plate.

5. The system of claim 1, wherein the second plate further comprises a vent extending from the first side of the second plate to the second side of the second plate.

6. The system of claim 1, wherein the printed circuit board comprises an electrowetting surface.

7. The system of claim 1, wherein the printed circuit board comprises one or more heating elements.

8. The system of claim 1, wherein the first side of the second plate is coupled to the second side of the first plate by a plurality of tabs extending from the second side of the first plate and engaged in a plurality of slots in the second plate.

9. A cartridge comprising:

(a) a first plate comprising:
- (i) a first side;
- (ii) a second side;
- (iii) a sample reservoir;
- (iv) a first port;
- (v) a channel connecting the sample reservoir and the first port;
- (vi) a sample dispensing channel opening onto the second side of the first plate, wherein the sample dispensing channel is in fluid communication with the sample reservoir;

(b) a frangible blister coupled to the first side of the plate and covering the first port;

(c) a removable sample input cap coupled to the first side of the plate and covering the sample reservoir;

(d) a second plate comprising:
- (i) a first side;
- (ii) a second side;
- (iii) a conduit passing through the second plate from the first side of the second plate to the second side of the second plate;

wherein the first side of the second plate is coupled to the second side of the first plate; and (e) an assay surface coupled to the second side of the second plate, where in the assay surface comprises an electrowetting surface and a printed circuit board.

10. The cartridge of claim 9, wherein the frangible blister contains a lysis buffer.

11. The cartridge of claim 9, wherein the sample dispensing channel is in fluid communication with the sample reservoir via a sample dispensing gutter.

12. The cartridge of claim 9, further comprising a gasket disposed between the second side of the first plate and the first side of the second plate.

13. The cartridge of claim 9, wherein the second plate further comprises a vent extending from the first side of the second plate to the second side of the second plate.

14. The cartridge of claim 9, wherein the printed circuit board comprises one or more heating elements.

15. The cartridge of claim 9, wherein the first side of the second plate is coupled to the second side of the first plate by a plurality of tabs extending from the second side of the first plate and engaged in a plurality of slots in the second plate.

* * * * *